US006006763A

United States Patent [19]

Mori et al.

[11] Patent Number: 6,006,763

[45] Date of Patent: Dec. 28, 1999

[54] SURFACE TREATMENT METHOD

[75] Inventors: Yoshiaki Mori; Takuya Miyakawa; Katsuhiro Takahashi; Takeshi Miyashita; Satoru Katagami, all of Suwa, Japan

[73] Assignee: Seiko Epson Corporation, Tokyo, Japan

[21] Appl. No.: 09/040,326

[22] Filed: Mar. 16, 1998

Related U.S. Application Data

[60] Division of application No. 08/474,561, Jun. 7, 1995, abandoned, which is a continuation-in-part of application No. 08/372,755, Jan. 13, 1995.

[30] Foreign Application Priority Data

Jan. 11, 1995 [JP] Japan ..... 7-2950

[51] Int. Cl.[6] ..... B08B 3/04; B08B 7/00

[52] U.S. Cl. ..... 134/1.1; 134/1.2; 134/10; 216/67; 438/704; 438/710

[58] Field of Search ..... 134/1.1, 1.2, 2, 134/26, 10; 438/704, 710; 216/57, 67, 83

[56] References Cited

U.S. PATENT DOCUMENTS

| | | | |
|---|---|---|---|
| 3,438,873 | 4/1969 | Schmidt | 438/704 |
| 3,762,941 | 10/1973 | Hou | 117/93.1 |
| 4,012,307 | 3/1977 | Phillips | 204/192 |
| 4,430,547 | 2/1984 | Yoneda et al. | 219/121 |
| 4,602,981 | 7/1986 | Chen et al. | 438/710 |
| 4,705,593 | 11/1987 | Haigh et al. | 156/635 |
| 4,708,766 | 11/1987 | Hynecek | 156/643 |
| 4,749,440 | 6/1988 | Blackwood et al. | 156/646 |
| 4,857,382 | 8/1989 | Liu et al. | 428/156 |
| 4,921,157 | 5/1990 | Dishon et al. | 228/124 |
| 4,957,062 | 9/1990 | Schuurmans et al. | 118/723 |
| 4,980,022 | 12/1990 | Fujimura et al. | 438/704 |
| 5,000,819 | 3/1991 | Pedder et al. | 156/643 |
| 5,045,166 | 9/1991 | Bobbio | 204/192 |
| 5,120,568 | 6/1992 | Schuurmans et al. | 427/37 |
| 5,126,164 | 6/1992 | Okazaki et al. | 427/39 |
| 5,147,520 | 9/1992 | Bobbio | 204/192 |
| 5,178,682 | 1/1993 | Tsukamoto et al. | 118/722 |
| 5,201,995 | 4/1993 | Reisman et al. | 156/646 |
| 5,221,423 | 6/1993 | Sugino et al. | 438/704 |
| 5,225,659 | 7/1993 | Kusano et al. | 249/121 |
| 5,240,559 | 8/1993 | Ishida | 456/666 |
| 5,290,378 | 3/1994 | Kusano et al. | 156/272 |
| 5,292,370 | 3/1994 | Tsai et al. | 118/723 |
| 5,316,739 | 5/1994 | Yoshikawa et al. | 422/186 |
| 5,340,618 | 8/1994 | Tanisaki et al. | 427/488 |
| 5,368,685 | 11/1994 | Kumihashi et al. | 156/643 |
| 5,384,167 | 1/1995 | Nishiwaki et al. | 427/569 |
| 5,391,855 | 2/1995 | Tanisaki | 219/121.43 |
| 5,399,830 | 3/1995 | Maruyama | 219/121.43 |
| 5,407,121 | 4/1995 | Koopman et al. | 228/206 |
| 5,449,432 | 9/1995 | Hanawa | 156/643.1 |
| 5,499,754 | 3/1996 | Bobbio et al. | 228/42 |
| 5,597,438 | 1/1997 | Grewal et al. | 156/345 |
| 5,723,383 | 3/1998 | Kosugi et al. | 438/710 |

FOREIGN PATENT DOCUMENTS

| | | |
|---|---|---|
| 371693 | 6/1990 | European Pat. Off. . |
| 59-158525 | 9/1984 | Japan . |
| 60-1861 | 1/1985 | Japan . |
| 2-281734 | 11/1990 | Japan . |
| 6-190269 | 12/1992 | Japan . |
| 5-82478 | 4/1993 | Japan . |
| 6-2149 | 1/1994 | Japan . |

*Primary Examiner*—Randy Gulakowski
*Assistant Examiner*—Saeed Chaudhry
*Attorney, Agent, or Firm*—Stroock & Stroock & Lavan LLP

[57] ABSTRACT

A method for surface treatment of a substrate is described in which a gas discharge at or about atmospheric pressure produces activated gas or active species which are then used for surface treatment of a substrate. When the discharge gas contains oxygen, for example, surface treatment forms a metal oxide film on a metal circuit on a substrate. If, however, the gas contains hydrogen or an organic substance, a metal oxide film, such as a transparent electrode formed on the surface of a liquid crystal panel, is reduced. Alternatively, by causing discharge to take place adjacent to the surface of a liquid, or bubbled through a liquid, a liquid may be used for surface treatment of a substrate without risk of thermal or electrical damage to the substrate.

8 Claims, 17 Drawing Sheets

SURFACE TREATMENT METHOD

CROSS REFERENCE TO RELATED APPLICATION

This application is a division of application Ser. No. 08/474,561, filed Jun. 7, 1995 now abandoned, which itself is a Continuation-In-Part of application Ser. No. 08/372,755, filed on Jan. 13, 1995.

BACKGROUND OF THE INVENTION

1. Field of the Invention

The present invention relates generally to a technique for oxidizing or reducing the surface of a work to be processed, removing or cleaning organic or inorganic substances and performing various surface treatments, and more particularly to a method and an apparatus for applying surface treatment to the surfaces of semiconductor devices, such as IC's, circuit boards and liquid crystal substrates, and circuits and electrodes formed on these surfaces.

2. Related Background Art

Heretofore, a variety of surface treatment techniques have been employed in the field for manufacturing semiconductor devices. For example, in a case where organic substances, such as a residue from soldering flux, are removed, a wet cleaning method using an organic solvent or a dry cleaning method, in which the organic substances are irradiated with ozone or ultraviolet rays to cause chemical reactions to take place so as to remove the organic substances, has been employed. If the wet cleaning method is employed, there is a risk that the electronic elements may be damaged. With the dry cleaning method, the ability to remove organic substances having large molecular weights is too poor to expect a satisfactory cleaning effect. Accordingly, a method has been developed recently in which gas discharge plasma, generated in a vacuum, is used to perform the surface treatment.

For example, in Japanese Patent Laid-Open No. 58-147143, there is disclosed a method that comprises the steps of using oxygen gas activated by microwave discharge performed in a reduced pressure environment to treat the surface of a lead frame so as to improve the hermetic contact of the leads with resin.

In Japanese Patent Laid-Open No. 4-116837, a method is disclosed in which 1 to 10 Torr of hydrogen gas is introduced into a plasma etching apparatus, and discharge is performed so as to cause reduction and remove oxides.

In Japanese Patent Laid-Open No. 5-160170, there is disclosed a method in which high-frequency voltage is applied to an electrode in a reduced pressure processing chamber, to generate argon-oxygen oxidizing plasma or hydrogen reducing plasma to etch a lead frame.

However, in the case where plasma discharge takes place in a vacuum or in a reduced pressure environment, special equipment, such as a vacuum chamber and a vacuum pump are required. Thus, the overall size of the apparatus is enlarged and the structure of the apparatus is unnecessarily complex. Therefore, the cost of the apparatus as well as the cost of performing the method cannot be reduced. What is worse, the pressure in the chamber must be reduced and maintained for the entire time of performing the discharge. Therefore, the time it takes to complete the process is also lengthened.

Since the processing performance is unsatisfactory and the operation cannot easily be completed in a short time, the manufacturing yield deteriorates. Moreover, the plasma discharge in a vacuum or in a reduced pressure environment, raises the risk of thermal or electrical damage because large quantities of electrons and ions are present with respect to activated, or high energy gas molecules. As a result, portions of the work to be processed may be damaged or affected adversely.

On the other hand, methods have been disclosed in recent years, each method including the step of using noble gas and a small quantity of reaction gas to generate plasma at or about atmospheric pressure to perform a variety of surface treatments, such as ashing and etching. The foregoing methods usually include the step of causing discharge to take place directly between a high-frequency electrode and a work to be processed. For example, in Japanese Patent Laid-Open No. 4-334543, a method has been disclosed in which plasma is generated in a pipe to process the inner surface of the pipe and substances passing through the pipe. Furthermore, a method is known that employs a surface treatment apparatus disclosed in Japanese Patent Laid-Open No. 3-219082, in which discharge takes place between a power-source electrode and a grounded electrode, and the plasma produced by discharge is sprayed to the surface of a work to be processed, optionally to form a desired film from the activated gas.

In recent years, to meet the desire for improving the performance and reducing the size of semiconductor apparatuses, IC elements and circuit boards of a type using multi-layer circuits have been used widely. In a case where a multi-layer circuit is formed on a substrate, initially traditional photo-lithography techniques are used to form a metal circuit made of conductive metal, such as aluminum or the like, on the substrate by patterning, followed by being covered with an insulating film made of $SiO_2$ or the like. The second metal circuit layer is formed on the insulating film, by etching a pattern into an applied metal film similarly by the conventional photo-lithographic technique so that a desired circuit pattern is formed. However, since a pin hole can easily be formed in the $SiO_2$ insulating film, patterning of the second metal circuit layer formed on the $SiO_2$ film raises a risk that the first or lower metal circuit formed under the $SiO_2$ insulating film will be undesirably etched and thereby damaged. Accordingly, a method has been employed in which the $SiO_2$ insulating film is made to be excessively thickened to avoid pinholes, or like imperfections. However, a long time and great labor are required to form the $SiO_2$ insulating film of excessive thickness, thus resulting in the cost being raised, time lengthened and the manufacturing yield severely deteriorated. Furthermore, the semiconductor device is thickened more than necessary, and therefore the desire for reducing the size and the thickness of the substrate and the electronic elements cannot be met.

Liquid crystal devices (LCD) usually comprise a glass substrate using a transparent electrode made of Indium-Titanium-Oxide (ITO) or the like. In a particular case of a liquid crystal device for use in a word processor or a personal computer screen, since a relatively large electric current flows when it is operated, the transparent electrode must have as weak a circuit resistance as possible. Accordingly, a method has been employed in which the thickness of the transparent electrode is increased. However, since the transparent electrode is usually formed by a vacuum film-forming method, a long time is required to form the same at the desired thickness, and therefore the cost cannot be reduced. Furthermore, the transparency deteriorates in proportion to the thickness of the transparent electrode, thus adversely affecting the function of the liquid crystal display.

To overcome the foregoing problems, the inventors of the present invention paid attention to the fact that previous coating of the surface of the lower metal circuit with an oxide is useful to protect the lower metal circuit from being etched at the time of patterning the upper metal circuit, even if the $SiO_2$ film formed on the lower metal circuit has pin holes or other imperfections. Furthermore, coating of the surface of a metal circuit or an electrode that appears on the surface of the substrate with a metal oxide enables the surface to have corrosion resistance against a variety of contamination factors. As a result, the reliability of the circuit and the like can be improved and the lifetime of the same can be lengthened.

Furthermore, the inventors of the present invention paid attention to a fact that reduction and metallizing of a transparent electrode enables a desired low resistance to be realized without the necessity of excessively thickening the transparent electrode when the electrode is made of a metal oxide. However, in any case, the foregoing surface treatment techniques encounter a variety of difficulties in practical use.

When a liquid crystal display apparatus is manufactured in the conventional manner, an oriented film has been formed on the surface of a liquid crystal panel by a method including the steps of forming a heat-resisting synthetic resin coating film having an electrical insulating characteristic and made of, for example, polyimide, on the substrate; and rubbing the surface of that coating film in one direction with a roller around which a cloth is wound. The substrate and resin coating are subjected to a rubbing process, so that the film is oriented. However, the foregoing method in which the surface is physically rubbed raises a problem in that the synthetic resin coating film may be separated from the substrate, and dust or the like allowed to adhere to the cloth wound around the roller or the surface of the coating film damages the surface of the coating film. Although the orientation must be realized uniformly, the conventional methods produce results that vary considerably. In addition, the angles and the inclinations scatter considerably, and the surface subjected to the rubbing process cannot be evaluated easily for determining when the rubbing process has been completed. In addition, the angle of the oriented film cannot be easily controlled except by trial and error of an experienced operator.

SUMMARY OF THE INVENTION

Generally speaking, in accordance with the invention, a surface treatment method for a substrate includes the steps of: causing gas discharge to take place in gas at or about atmospheric pressure containing at least oxygen and exposing a metal layer formed on a substrate to activated gas produced by the discharge so that the surface of a metal layer on a substrate is oxidized.

A method of forming a multi-layer circuit substrate is characterized in such a manner that a first metal circuit formed on a substrate is coated with an insulating film formed on the first metal circuit, and a metal film is formed on the insulating film and is etched so that a second metal circuit is formed into a desired pattern, the method of forming a multi-layer circuit substrate including the step of: causing gas discharge to take place in gas at or about atmospheric pressure prior to forming the insulating film on the first metal circuit in order to expose the first metal circuit to activated gas produced by the discharge for forming a protective oxide coating on the first metal circuit.

A surface treatment method for a substrate, includes the steps of: causing gas discharge to take place in gas at or about atmospheric pressure containing at least hydrogen or an organic substance and exposing a metal oxide layer formed on a substrate to activators of the gas produced due to the discharge so as to reduce the metal oxide layer.

A surface treatment method for a substrate, in addition to the foregoing characteristics, is characterized in that the gas discharge may additionally contain steam. A surface treatment method for a substrate is further characterized in that an organic substance may be previously applied to the surface of the substrate. A surface treatment method for a substrate is further characterized in that a vaporized organic substance may be added to the gas discharge.

A surface treatment method includes the step of causing gas discharge to take place at or about atmospheric pressure in a predetermined gas at a position adjacent to the surface of a liquid so that the liquid contains activated species. A method of surface treatment of a substrate is, in addition to the foregoing characteristics, characterized in that the liquid may be used after the gas discharge has been caused to take place adjacent to it to apply surface treatment to the surface of a work to be processed. A surface treatment method is further characterized in that the work to be processed may be immersed in the liquid.

A surface treatment apparatus includes: a container for a liquid; means for causing gas discharge to take place at or about atmospheric pressure in a predetermined gas and means for supplying the activated predetermined gas to a position adjacent to the liquid level in the container. An apparatus, in addition to the foregoing characteristics may be further characterized by including cleaning means, and circulating means for circulating the liquid from the container to the cleaning means and back to the container. An apparatus may be further characterized in that a work to be processed may be immersed in the liquid in the container. An apparatus is further characterized by comprising means for applying the liquid in the container to a work to be processed.

A surface treatment method includes the steps of: causing gas discharge to take place in a predetermined gas at or about atmospheric pressure and supplying activated gas produced due to the gas discharge into a liquid; and using the liquid to treat the surface of a work to be processed. A method may be, in addition to the foregoing characteristics, further characterized in that the work to be processed may be immersed in the liquid.

A surface treatment apparatus includes: a container for a liquid; a discharger for causing gas discharge to take place at or about atmospheric pressure in a predetermined gas and bubbler for supplying activated gas produced due to the discharge into the liquid in the container. An apparatus may be, in addition to the foregoing characteristics, further characterized in that a work to be processed may be immersed in the liquid in the container. A surface treatment apparatus may be further characterized by including means for applying the liquid in the container to a work to be processed.

A method of forming an oriented film of a liquid crystal panel includes the steps of: causing gas discharge to take place at or about atmospheric pressure in a predetermined gas and jetting a gas flow containing activated gas produced by the discharge to the surface of the substrate in such a manner that the gas flow is jetted at an angle with respect to the surface to align the film to a desired direction of orientation by the action at the activated gas. A method, in addition to the foregoing characteristics, may be further characterized in that a synthetic resin coating film to be formed into an oriented film may be previously applied to the surface of the substrate, and the synthetic resin coating film may be then exposed to the activated gas. Alternatively, a method may be characterized in that the gas used in the discharge may contain an organic substance which coats the substrate and that after a coating film has been formed on the surface of the substrate by the activated gas, a second gas discharge is caused to take place at or about atmospheric pressure, and the surface of the substrate having the coating film formed thereon is exposed to the second activated gas produced by the second gas discharge.

A method of forming an oriented film of a liquid crystal panel includes the steps of: causing gas discharge to take place at or about atmospheric pressure and jetting a predetermined gas containing an organic substance, in a desired direction of orientation toward the surface of the substrate which is exposed to the discharge; and forming an oriented coating film on the surface of the substrate by the activated gas produced due to the discharge.

Therefore, according to the surface treatment method for a substrate here disclosed, a relatively simple structure is required to cause the gas discharge to take place at or about atmospheric pressure to produce activated oxygen gas including oxygen radicals and ozone, the action of which causes the metal layer on the surface of the substrate to be oxidized so that the surface of the substrate is covered with a metal oxide.

According to the method of forming a multi-layer circuit substrate here disclosed, the surface treatment method is used to cover the surface of the first metal circuit of a multi-layer circuit with a metal oxide so that, even if the insulating film formed on the first metal circuit has pin holes, undesirable etching of the first metal circuit can be prevented when the second metal circuit is patterned.

According to the surface treatment method for a substrate here disclosed, a relatively simple structure is required to cause gas discharge to take place at or about atmospheric pressure so that hydrogen radicals are produced, and/or organic substances are dissociated, electrolytically dissociated and excited and to produce activated gas, such as organic substance, carbon and hydrogen ion exciters. Thus, reactions of the activated gas reduce and metallize the metal oxide layer on the surface of the substrate.

According to the surface treatment method for a substrate here disclosed, the gas for causing gas discharge to take place may contain steam so that the activated gas raises the reduction speed. According to the surface treatment method for a substrate here disclosed an organic substance may be previously applied to the surface of the substrate so that the organic substances can be efficiently dissociated, electrolytically dissociated and excited by the activated gas formed by the gas discharge. According to the method here disclosed, vaporized organic substances may be supplied to the gas discharge region so that dissociation, electrolytic dissociation and excitation of the organic substances are enhanced. As a result, the effect of the reduction process can be improved.

According to the surface treatment method here disclosed, the action of the activated gas produced due to the gas discharge caused to take place under at or about atmospheric pressure near the surface of a liquid enables the liquid to be activated, or causes the activated gas to be mixed with the liquid so that the liquid is activated and has surface treatment properties. According to the method here disclosed, the activated liquid causes a work to be surface treated regardless of the discharge position without any thermal or electrical damage. According to the method, the surface of a work to be processed can be directly treated by the foregoing activated liquid.

According to the surface treatment apparatus here disclosed, the method can be embodied in a device such that the activated gas produced due to plasma generated at or about the atmospheric pressure is allowed to act on the liquid in the container to produce activated liquid or treat the surface of the work to be processed through the liquid. According to the apparatus here disclosed, impurity ions, dust and the like generated in the activated liquid due to the surface treatment can be removed to maintain the purity of the liquid at a satisfactory level by a purifier. According to the apparatus here disclosed, the work to be processed can be subjected to direct surface treatment in an activated liquid of the foregoing type. According to the apparatus have disclosed, a work to be processed can be subjected to surface treatment at a position away from the gas discharge position, where the activated liquid of the foregoing type is generated.

According to the surface treatment method here disclosed, use of the activated liquid, into which the activated gas produced due to gas discharge is bubbled, will enable the surface of a work to be treated. Since the work to be processed may be placed at position away from the gas discharge position, the processing performance can be adjusted appropriately to be adaptable to the shape, dimensions and the number of the works to be processed, the environment in which the gas discharge takes place, and other processing conditions. According to the method here disclosed, the surface of the work to be processed can be directly treated by the foregoing liquid.

According to the surface treatment apparatus here disclosed, the method can be embodied such that the container for the liquid and the gas discharge generating means are disposed in such a manner that they are connected to each other by the gas supply means. As a result, the type and quantity of activate gas to be supplied into the liquid can be controlled to be adaptable to the size, dimensions and the shape of the work to be processed and other various conditions, the supply method can be changed appropriately in stream, and the size and shape of the container for the liquid can be changed. According to the apparatus here disclosed, the surface of the work to be processed can be directly treated in the foregoing activated liquid. According to the apparatus here disclosed, the work to be processed can be subjected to surface treatment at a desired particular position.

According to the method of forming an oriented film of a liquid crystal panel here disclosed, activated gas is used to act on the surface of the substrate at an angle relative to the surface so that an oriented film is formed on the surface of the substrate in a non-contact manner in the direction of the gas flow. According to the method here disclosed, the synthetic resin coating film on the surface of the substrate may be oriented in the direction of the gas flow. According to the method here disclosed, organic substances may be polymerized on the surface of the substrate so that a desired oriented film may be directly formed thereon.

According to the method of forming an oriented film of a liquid crystal panel here disclosed, the plasma at or about atmospheric pressure is used to relatively easily polymerize organic substances on the surface of the substrate to form a synthetic resin coating film and to orient the synthetic resin coating film in a desired direction in a non-contact manner.

An object of the present invention directed to overcome the foregoing problems is to provide a surface treatment method for a substrate which is capable of easily treating the surfaces of a metal circuit and an electrode formed on the surface of the substrate without a risk of thermal or electrical damage. In this manner, desired corrosion resistance is attained to improve the reliability of the circuit or reduce the resistance without the need of providing special vacuum or pressure-reduction equipment, and to simplify the overall structure of the apparatus, reduce the size of the same, safely and locally surface treat a work, reduce the cost and improve the processing performance.

Another object of the present invention is to provide a method of forming a multi-layer circuit on a substrate which employs the foregoing surface treatment method, which is able to insulate and protect a first circuit without the necessity of excessively thickening the interlayer insulating film, the cost of which can be reduced and which exhibits excellent reliability.

Another object of the present invention is to provide a surface treatment method and an apparatus therefor, which has a relatively simple structure that does not require any special equipment for realizing a vacuum state or reducing the pressure to easily and efficiently perform a variety of surface treatments, such as etching, removal of organic substances and inorganic substance and cleaning, as well as oxidation and reduction, with a low cost, and which is capable of selectively performing a single wafer process or a batch process.

Another object of the present invention is to provide a method of forming an oriented film on a liquid crystal panel to be employed in manufacturing a liquid crystal display apparatus, the method being designed to perform a non-contact process to protect the surface of a synthetic resin coating film from being damaged or separated from the liquid crystal and which is capable of reproducibly and uniformly orienting the surface at a particular angle.

Another object of the present invention is to provide a method which is capable of forming an oriented film directly on the surface of a substrate of a liquid crystal panel without first adding a synthetic resin coating film.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

Figure 1:
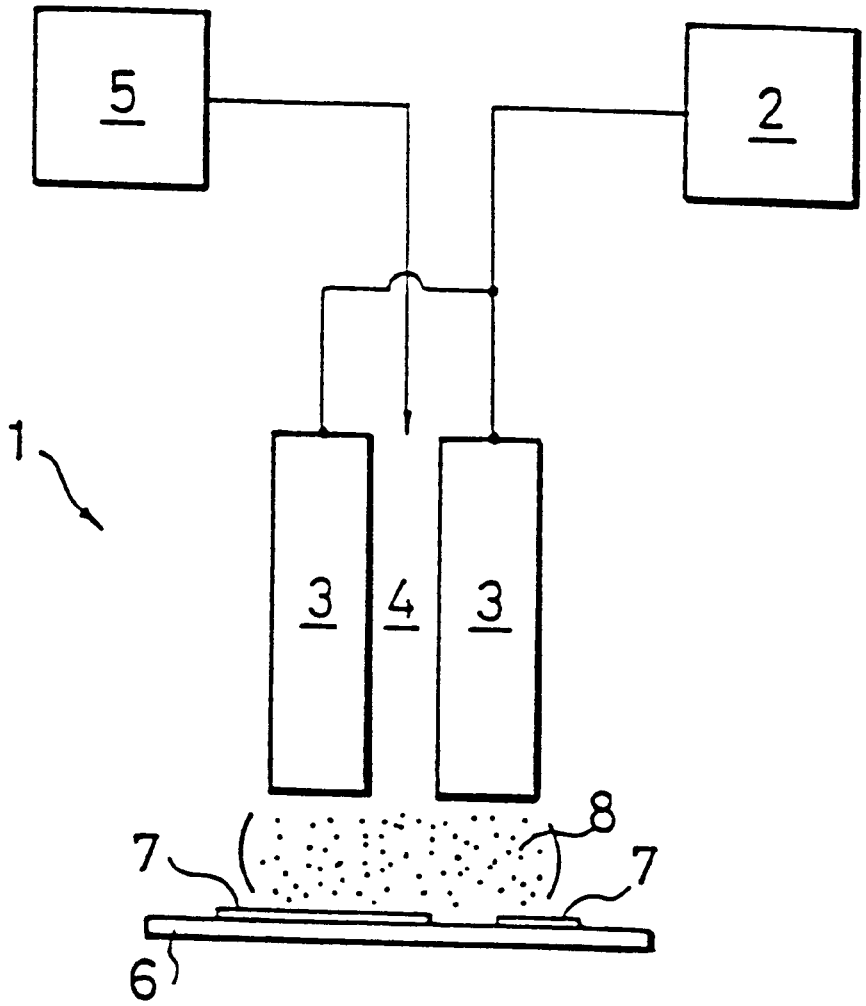
FIG. 1 is a block diagram showing the structure of a surface treatment apparatus for use in a surface treatment method for a substrate according to the present invention.

Referring now to FIG. 1, a surface treatment apparatus 1 comprises a pair of electrodes 3 connected to a power source 2 and facing each other at a predetermined distance. A space 4 defined between the two electrodes 3 is supplied with gas for discharge from a gas supply apparatus 5. A substrate 6 to be subjected to surface treatment is disposed just below the two electrodes 3 such that gas for discharge will flow from the gas supply apparatus 5 through the space 4 between the two electrodes 3 and onto the surface of the substrate 6. The substrate 6 has, on the upper surface thereof, a metal (e.g. aluminum) circuit 7.

The gas discharge is supplied to the space 4 from the gas supply apparatus 5 so that the gas for discharge is substituted for the ambient atmosphere between the two electrodes 3 and the ambient atmosphere below the leading portions of the electrodes, and the surface of the substrate 6. When predetermined voltage is applied from the power source 2 to the electrodes 3, gas discharge takes place between the two electrodes 3 and the substrate 6. In a discharge region 8, a variety of reactions, such as dissociation, electrolytic dissociation and excitation, of the discharging gas take place due to plasma at this time. The foregoing discharge takes place particularly intensely between an aluminum metal circuit 7 formed on the upper surface of the substrate 6 and the two electrodes 3.

Figure 2A:
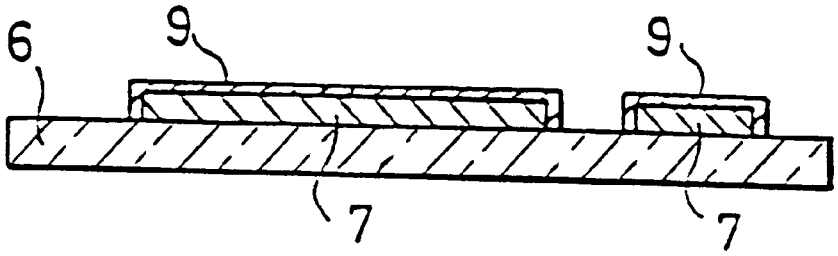
FIG. 2(A) is a sectional view of a substrate and metal circuit for forming a multi-layer circuit after surface treatment by the surface treatment method for a substrate according to the present invention.

In this embodiment, the discharging gas is typically a mixed gas of helium and oxygen. As a result, activated gas or active species, such as oxygen ions and exciters, are generated in the discharge region 8. The surface of the metal circuit 7 is exposed to the foregoing activators so as to be oxidized so that a thin film 9 as shown in FIG. 2(A) and made of a metal oxide is formed.

In general, when noble gas of, for example, helium, is used at or about atmospheric pressure and is applied with high-frequency voltage, gas discharge takes place easily and the discharge can be made uniform. Thus, the work to be exposed to the activated gas can be satisfactorily protected from being damaged. If compressed air or mixed gas of nitrogen and oxygen is used as the discharging gas, the metal circuit can similarly be oxidized. Since costly helium gas and other noble gases raise the manufacturing cost, noble gas of, for example, helium or argon, is used only at the start of the discharge, and appropriate low-cost gas, such as compressed air, is then introduced into the gas flow and the noble gas reduced or eliminated after the discharge has begun.

As for the temperature condition, the process may be performed at room temperature, or any convenient temperature at which a problem does not occur such that the device or the substrate is thermally damaged. As a matter of course, it is preferable that the substrate be heated to simply raise the oxidation rate.

Figure 2B:
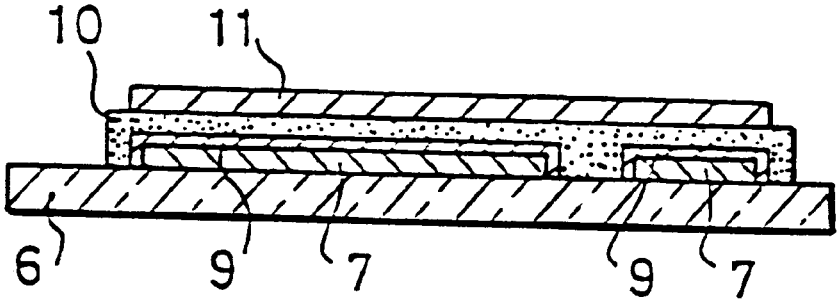
FIG. 2(B) is a sectional view of the substrate and metal circuit for forming a multi-layer circuit of FIG. 2(A) to which an insulating film and metal film have been applied according to the present invention.

The substrate 6, which has the metal circuit 7 whose surface has been coated with the metal oxide film 9 as described above, may then be subjected to a process in which an insulating film 10 made of, for example, $SiO_2$, and having a predetermined thickness is formed on the metal circuit 7, as shown in FIG. 2(B). Then, the insulating film 10 is coated with a metal film 11 made of, for example, aluminum, followed by being etched similarly to the conventional technique using photo-lithography so that a second metal circuit is formed in a desired wiring circuit pattern.

According to the present invention the surface of the lower metal circuit is oxidized and coated with metal oxide which eliminates the necessity of forming the interlayer insulating film at an excessive thickness to protect the lower metal circuit from being undesirably etched when the upper metal circuit is etched, regardless of whether or not pinholes are present. Thus, a multi-layer circuit consisting of two layers can be formed on the substrate 6 that is thinner than a corresponding multi-layer circuit whose insulating layer needs to be thick to prevent unwanted etching of the lower metal circuit due to defects or pinholes in the insulating layer. By repeating the foregoing process, a multi-layer circuit consisting of three or four layers can be formed.

Although the example of this embodiment has the characteristic that the metal circuit 7 to be formed on the substrate 6 is made of aluminum, the metal circuit 7 may, of course, be made of another metal, such as, for example, copper, or Indium-Tin-Oxide (ITO). Furthermore, the present invention is not limited to the multi-layer circuit structure according to this embodiment, but can be applied to surface treatment of any metal circuit or electrodes on the surface of a substrate such that surface treatment enables the metal circuit or the electrodes to have corrosion resistance due to the metal oxide layer. Therefore, reliability against contamination or the like can be improved, and the lifetime of the circuit can be lengthened.

Figure 3:
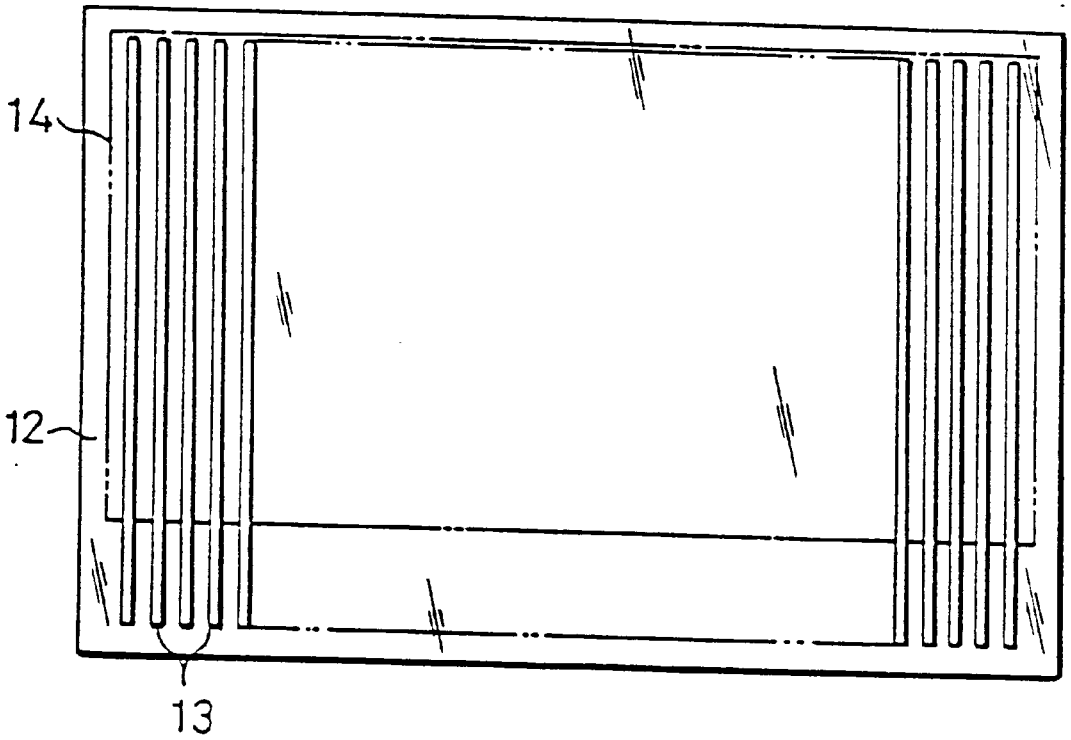
FIG. 3 is a plan view showing a glass substrate to be subjected to a reduction process by a surface treatment method for a substrate according to the present invention.

FIG. 3 is a diagram showing a glass substrate 12 to which the method of treating the surface of a substrate according to the present invention is applied. The glass substrate 12 may be used in a liquid crystal display apparatus and comprises a multiplicity of transparent electrodes 13 made of, for example, ITO. In this example, the surface treatment apparatus, as shown in FIG. 1, is used as in the prior above embodiment, and gas containing at least hydrogen or an organic substance is used as the discharging gas, and is supplied to cause gas discharge to take place between the electrodes 3 and the substrate 6 which may be a glass substrate 12. By generating the plasma as described above, activated gas containing active species, such as hydrogen ions and exciters, can be produced if the discharging gas contains hydrogen. If, however, the discharging gas contains organic substances, the organic substances are dissociated, electrolytically dissociated and excited so that the activated gas contains active species, for example, organic, carbon and hydrogen ion exciters, which are produced by the discharge. By interposing a device for selecting which areas are surface treated, such as a mask, on the glass substrate 12, only the transparent electrodes 13 and not the display region 14 are exposed to the foregoing activated gas.

Since the transparent electrodes 13, as described above, may be made of oxides of metal, such as ITO, they are typically reduced and metallized due to the action of the activated gas. Thus, the electric resistance of the transparent electrodes 13 can be lowered. Therefore, the necessity for the conventional technique to form thick transparent electrodes in order to lower the resistance can be eliminated and the electric performance required to serve as electrodes while maintaining excellent transparency for use in a liquid crystal display apparatus can be realized.

The necessity for the foregoing organic substances for generating the activated gas to be contained in the discharging gas may be eliminated. For example, in another embodiment, the organic substances may be applied to the surface of the glass substrate 12 prior to surface treatment. In this case, the gas is dissociated, electrolytically dissociated and excited in the discharge region between the electrodes 3 and the glass substrate 12 due to the plasma, causing the energy level to be raised. Therefore, a portion of the applied organic substances is evaporated and exposed to the discharge and activated gas so that the organic substances are dissociated, electrolytically dissociated and excited as in the prior example. As a result, activated gas is produced similarly to the foregoing embodiment. Another portion of the applied film of organic substance receives energy from the activated gas of the gas having the high energy level so as to be dissociated, electrolytically dissociated and excited so that the organic substances are activated and thus, active species, such as organic, carbon and hydrogen ions and exciters are created from the film. As a result, a reduction effect, similar to the case where the discharging gas contains organic substances directly from the gas supply 5, can be obtained. In another example, a separate gas supply means may be used to supply vaporized organic substances to the discharge region directly. Also in this case, a similar operation can be realized and similar effect can be obtained as in the prior examples.

If the discharging gas contains organic substances especially of a high molecular weight, the organic substances may polymerize and, thus, a thin polymer film can be formed on the surface of the work to be processed. In a case where forming of a polymer thin film must be prevented, it is preferable that gas containing low-molecular-weight organic substances be used or water may be additionally contained in the discharging gas.

Figure 4:
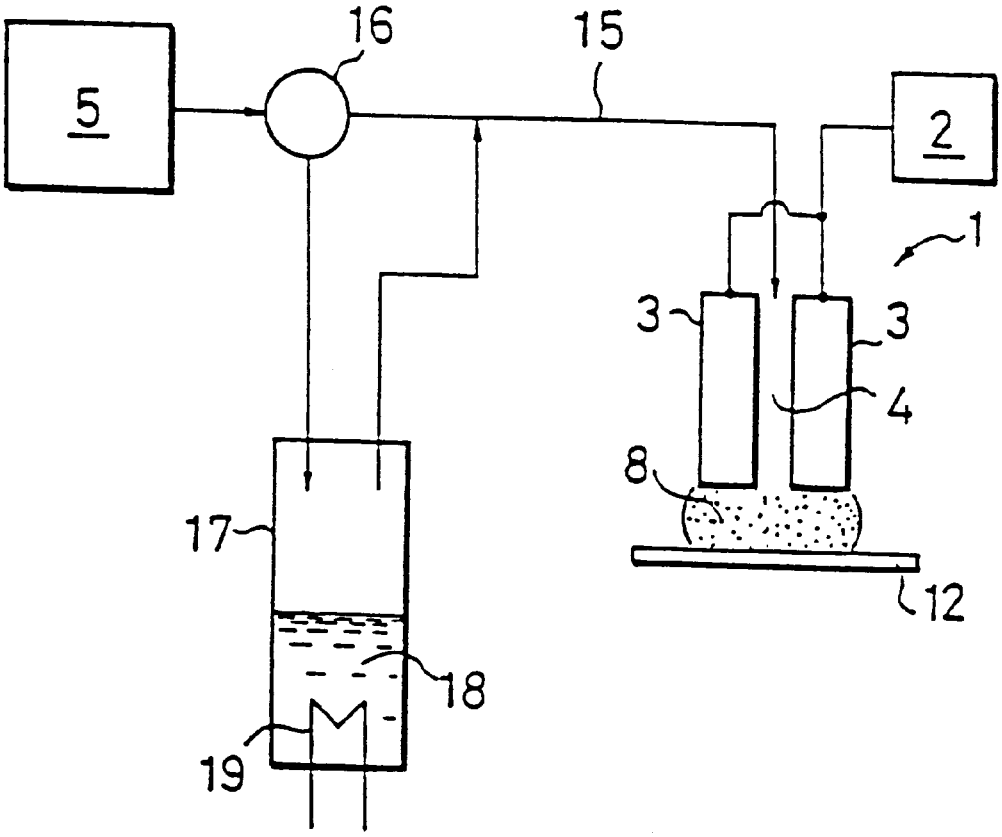
FIG. 4 is a block diagram showing a structure for causing steam or organic substance vaporized gas to be contained in the discharging gas in the reduction process according to the present invention.
Figure 5:
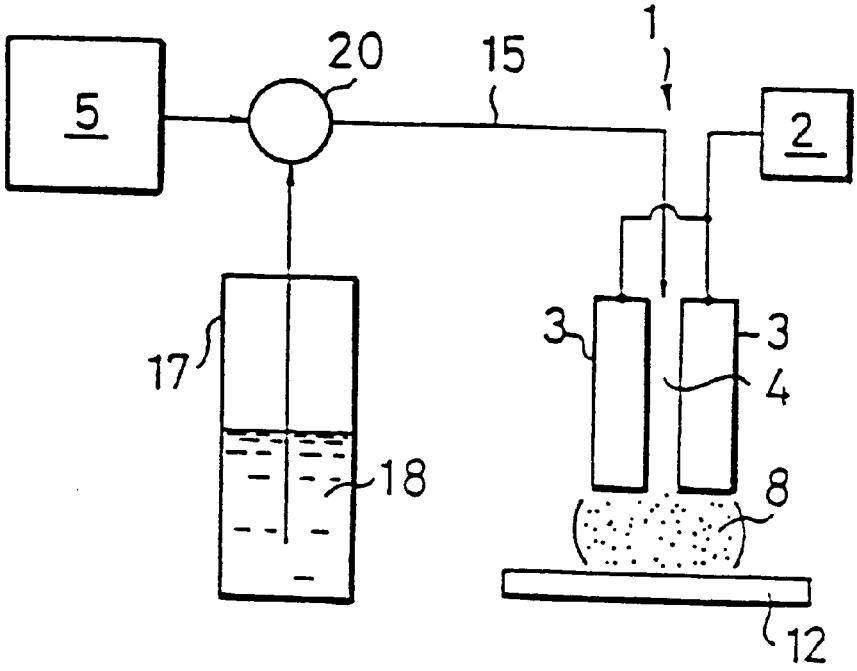
FIG. 5 is a block diagram showing a structure different from that shown in FIG. 4.
Figure 6:
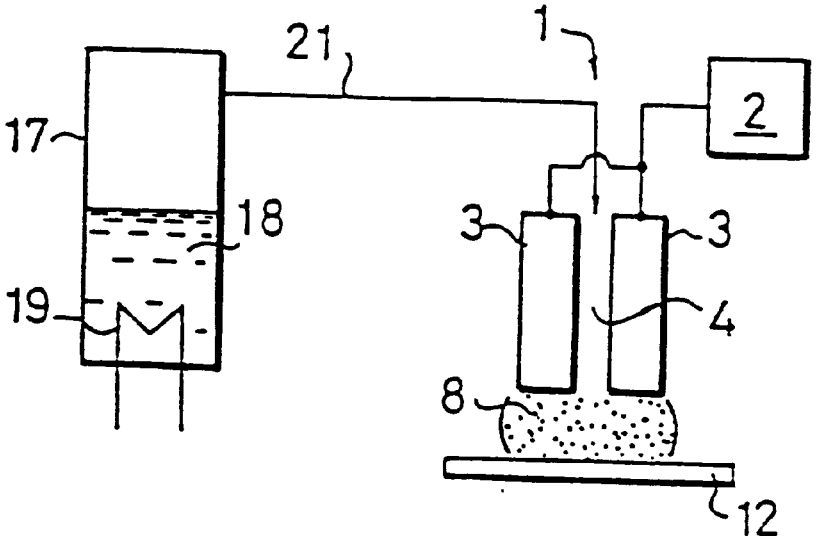
FIG. 6 is a block diagram showing another embodiment different from that shown in FIG. 4.

FIGS. 4 to 6 are diagrams showing specific structures for use in the case where water or low-molecular-weight organic substances are added to the discharging gas. In an embodiment shown in FIG. 4, a bypass is provided at an intermediate position of a conduit 15 for supplying the discharging gas from the gas supply apparatus 5 to the surface treatment apparatus 1 so as to supply a portion of the discharging gas into a cylinder 17 by adjusting a valve 16. The cylinder 17 accommodates water (preferably pure water) or liquid organic substances 18 so that a heater 19 is able to easily generate vapor gas of the foregoing water or organic substances. The discharging gas introduced into the cylinder 17 is caused to contain vapor gas of steam or organic substances 18, followed by being returned to the conduit 15 to be mixed with the discharging gas that is directly supplied from the gas supply apparatus 5 so as to be supplied to the surface treatment apparatus 1. The quantity of steam or the organic substances to be mixed with the discharging gas can be adjusted by a circuit in the valve 16 and the heater 19.

In the embodiment shown in FIG. 5, an atomizing apparatus 20 is disposed at an intermediate position of the conduit 15 establishing the connection between the gas supply apparatus 5 and the surface treatment apparatus 1. Thus, water or the liquid organic substances 18 are supplied from the cylinder 17 to the atomizing apparatus 20 so as to be added to the discharging gas supplied from the gas supply apparatus 5, while being atomized. Also in the foregoing case, a heater disposed in the cylinder 17 similarly to the embodiment shown in FIG. 4 will enhance atomization of water and liquid organic substances.

In the embodiment shown in FIG. 6, water or the liquid organic substances 18 contained in the cylinder 17 are heated by the heater 19 to generate steam or vapor gas of the liquid organic substances that is directly supplied to the surface treatment apparatus 1 or the discharge region 8 through a conduit 21 provided separately from that for the discharging gas to be supplied from the gas supply apparatus 5 (not shown). The conduit 21 can be connected to an intermediate position of the conduit 15 (not shown) that establishes the connection between the gas supply apparatus 5 and the surface treatment apparatus 1 to as well as enable steam or the vapor gas of the organic substances to be mixed with the discharging gas, followed by being supplied to the discharge region 8.

Experiments were performed to evaluate the effects obtainable from the examples where the surface treatment method according to the present invention was employed to reduce a work to be processed, resulting in the following: four types of discharging gas were used which consist of either only helium, mixed gas of helium and propane, mixed gas of helium and oxygen or mixed gas of helium and hydrogen. As for steam or the organic substances to be added to the discharging gas, three cases were examined: either decane ($C_{10}H_{22}$) was added, decane and water were added, or no substance was added. The power supply voltage for causing gas discharge to take place was set to 200 W. The flow rate of helium was 20 liters per minute. Results of the experiments were shown in Table 1 below.

TABLE 1

| Test No. | Type and Flow Rate of Gas Except He | Type and Flow Rate of Liquid | Polymerization Facility | Reduction Facility |
|---|---|---|---|---|
| 1 | Propane 200 ccm | No Liquid | C | A |
| 2 | No Gas | Decane 50 ccm | C | C |
| 3 | No Gas | Decane 200 ccm | A | A |
| 4 | Oxygen 200 ccm | No Liquid | C | D |
| 5 | Oxygen 50 ccm | Decane 200 ccm | A | A |
| 6 | Oxygen 100 ccm | Decane 200 ccm | C | B |
| 7 | Oxygen 200 ccm | Decane 200 ccm | C | D |
| 8 | No Gas | Decane 200 ccm<br>Water 200 ccm | B | A |
| 9 | Oxygen 50 ccm | Decane 200 ccm<br>Water 200 ccm | C | A |
| 10 | Oxygen 200 ccm | No Liquid | C | A |

Polymerization Facility
A: Polymer is produced.
B: Polymer is partially produced.
C: No polymerization is produced.
Reduction Facility
A: Reduction takes place.
B: Slight reduction takes place.
C: No change.
D: Oxidation takes place.

Referring to Table 1, the "Flow Rate of Gas" indicates the flow rate of gas realized when the subject liquid is vaporized. Note that the gas discharge is performed such that at least hydrogen or organic substances are supplied in the form of gas or liquid. In general, it is preferable that reduction be performed such that no polymer is formed on the surface of the work to be processed. As can be seen from the results of Table 1, the mixing of oxygen with the discharging gas will minimize the polymerization. However, the reduction performance deteriorates. The addition of water, though, enables the polymerization to be minimized without adverse influence on the reducing performance.

Figure 7:
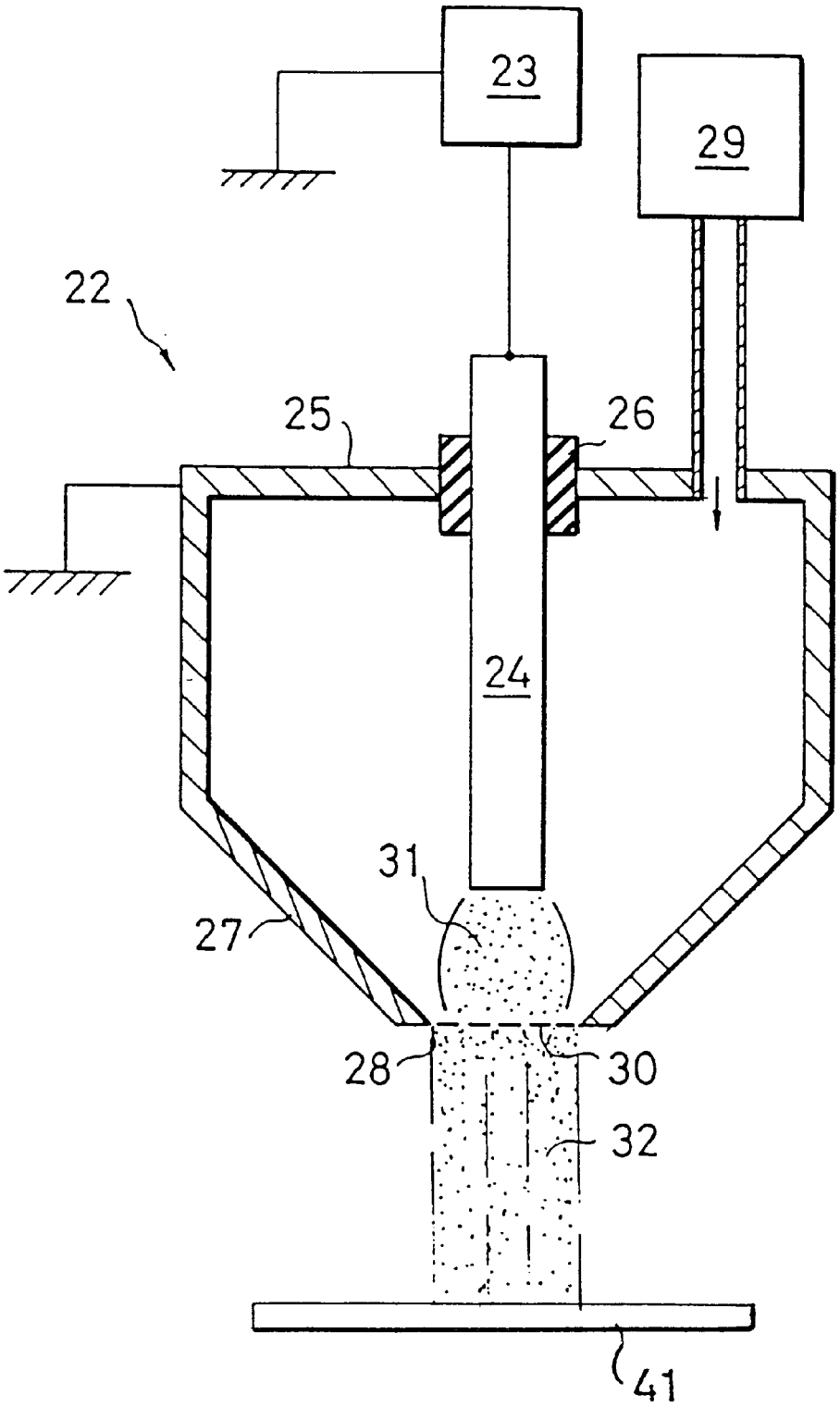
FIG. 7 is a sectional view showing another embodiment of the surface treatment apparatus for use in the surface treatment method according to the present invention.

FIG. 7 is a diagram showing an alternative embodiment of a surface treatment apparatus for use in the method according to the present invention. The surface treatment apparatus 22 comprises a rod-like electrode 24 connected to a power source 23 in such a manner that the electrode 24 is allowed to electrically float and is, by an insulating attaching member 26, held in the central portion of a box-shape metal cover 25 that has an opening. The metal cover 25 is grounded and completely encloses the electrode 24. The metal cover 25 has a lower end 27 extending proximate the leading end of the electrode 24 so that an opening 28 is formed in the lower portion of the metal cover 25. The lower end 27 serves as a ground electrode corresponding to the powered electrode 24.

The inside of the metal cover 25 is provided with a gas supply apparatus 29 for supplying the discharging gas. The opening 28 optionally has a metal mesh 30 secured thereto. A substrate 41, which constitutes the work which is surface treated, is disposed below and proximate the opening 28.

In the above structure, the predetermined discharging gas is supplied from the gas supply apparatus 29 to displace the ambient atmosphere for the inside of the metal cover 25. When voltage is applied from the power source 23 to the powered electrode 24, gas discharge takes place between the leading end of the electrode 24 and the lower end 27 of the grounded metal cover 25. Since the discharging gas is continuously supplied from the gas supply apparatus 29 to the inside of the metal cover 25, the activated gas produced in the discharge region 31 are, together with the discharging gas, formed into a reactive gas flow 32 which is jetted out through the opening 28 and towards the substrate. The activated gas contained in the reactive gas flow surface treats the surface of the substrate. Ions generated from the reactive gas flow 32 due to the foregoing discharge are optionally trapped by the metal mesh 30 so that ions are neutralized. As a result, the substrate to be applied with the surface treatment may be satisfactorily protected from being damaged by ions.

In another embodiment, a conduit, such as a flexible tube, is connected to the lower opening 28 of the metal cover 25, the conduit having a nozzle at the leading end thereof to jet out the reactive gas flow. The substrate to which the surface treatment is to be applied is separately disposed apart from the body of the surface treatment apparatus 22 so as to be exposed to the reactive gas flow through the conduit and through the nozzle. As a result, the flow rate of the gas flow, the shape of the nozzle and the like can be varied at the time of performing the surface treatment thus adapting the processing conditions to the particulars, such as the shape and dimensions of the substrate, which is a work to be processed. Therefore, the processing performance can be adjusted as desired, and the working efficiency can be improved.

Figure 8:
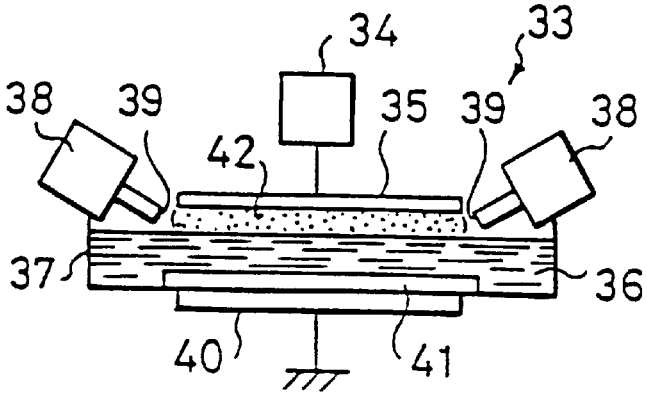
FIG. 8 is a block diagram showing a surface treatment apparatus for use in an embodiment of the surface treatment method different from that shown in FIG. 7.

FIG. 8 shows a surface treatment apparatus for use in another embodiment of the surface treatment method according to the present invention. The surface treatment apparatus 33 comprises a flat, planar powered electrode 35 connected to a power source 34 and disposed generally horizontally. A container 37 for accommodating a predetermined liquid 36 is disposed below the electrode 35. Furthermore, a gas supply apparatus 38 for supplying the discharging gas has a gas jetting-out port 39 disposed to point towards the small space formed between the electrode 35 and the liquid 36. The container 37 has, in the bottom portion thereof, a grounded metal plate 40 serving as a grounded electrode opposite the powered electrode 35, the metal plate 40 being disposed in parallel to the electrode 35. A work 41 to be applied with the surface treatment is immersed in the liquid 36 and placed at a position corresponding to and between the metal plate 40 and the powered electrode 35.

Similarly to each of the foregoing embodiments, a predetermined discharging gas is jetted out through the gas jetting-out port 39 of the gas supply apparatus 38 to displace the ambient atmosphere with the discharging gas between the electrode 35 and the surface of the liquid 36. When voltage is then applied from the power source 34 to the electrode 35, gas discharge takes place between the electrode 35 and the level of the liquid 36 in the discharge region 42. Activated gas of the discharging gas is produced by the plasma discharge followed by being mixed with the liquid 36 so that the work 41 is applied with the surface treatment.

In the case where gas containing oxygen or mixed gas of, for example, helium and oxygen, is used as the discharging gas, activated species, such as oxygen radicals and ozone, are produced in the activated gas in the discharge region 42 due to the gas discharge. In the case where the liquid 36 is water, preferably pure water, mixing of the foregoing ozone causes the liquid 36 to become ozone water which exhibits an oxidation decomposing property with respect to the work 41 to be surface treated similar to hydrogen peroxide. If the work 41 is applied with the surface treatment by the wet method using the hydrogen peroxide, the cost of the hydrogen peroxide raises the overall processing cost. What is worse, the hydrogen peroxide is toxic for human beings, causing a necessity to implement protective and precautions measures in handling. As a result, the operation takes a long time and is overly complicated. According to the present invention, satisfactory oxidation performance can be obtained while maintaining the overall process and a low cost. Furthermore, handling can be made easier, and the working efficiency can be improved.

In another embodiment, the discharging gas may be gas containing a fluorine compound, such as $CF_4$, $C_2F_6$ or $SF_6$. In this case, the gas discharge generates activated gas containing active species, such as fluorine ions and exciters. If the liquid 36 is water, fluorine ions are mixed with water so that the liquid 36 is made to be hydrogen fluoride (HF) water. Thus, the surface of the work 41 to be processed can be etched. The foregoing method can be used in, for example, removing an oxidized film from the surface of a work piece, such as silicon wafers at the time of wet-etching the work piece or silicon wafer.

In the example where the discharging gas contains nitrogen, for example, gas containing only nitrogen, mixed gas of nitrogen and helium or compressed air may be used. In a case where the liquid 36 is water, the activated gas contains active species, such as nitrogen ions and exciters. The nitrogen ions produced by the discharge are mixed with water so that water is converted into nitric acid. As a result, the liquid 36 has the cleaning performance equivalent to that of nitric acid with which organic substances or the like allowed to adhere to the surface of the work 41 to be processed can be removed. In particular, the above example is effective in wet etching of a resist formed on a substrate or the like after it has been subjected to ashing.

Since the surface treatment method according to the present invention has the features that discharging gas and the liquid 36 may be appropriately selected and combined, a variety of surface treatments, such as oxidizing, etching and cleaning, can easily be performed at a low cost. By maintaining, at a predetermined sufficiently high level, the purity of the liquid 36 in which the work to be processed is, for example, immersed, the work to be processed can be protected from being contaminated by substances generated during the surface treatment operation. A further modification of the above example of a surface treatment apparatus is shown in FIG. 9.

Figure 9:
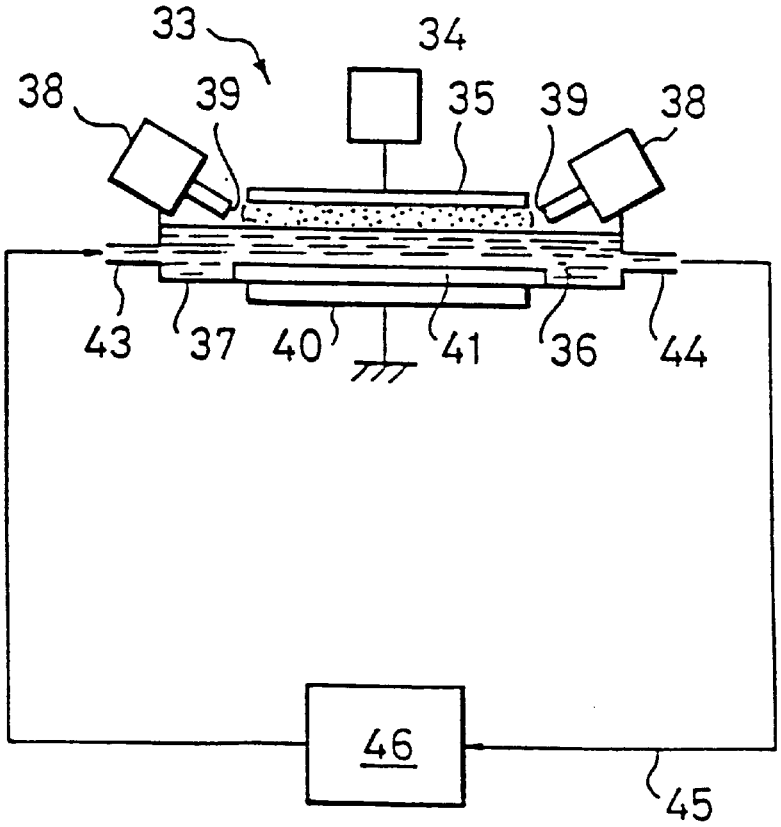
FIG. 9 is a block diagram showing a modification of the embodiment shown in FIG. 8.

In the embodiment shown in FIG. 9, a liquid injection port 43 and a liquid discharge port 44 are formed on opposite sides of the container 37 for accommodating the liquid 36. Furthermore, a water purifying apparatus 46 is disposed at an intermediate position of a circulating conduit 45 connecting the two parts. The liquid 36 in the container 37 is supplied through the discharge port 44 to the water purifying apparatus 46 by way of the circulating conduit 45 so that the water purifying apparatus 46 may remove impurity ions and dust generated during the surface treatment process, and then the liquid 36 is returned into the container 37 by the circulating conduit 45 and to the injection port 43. Therefore, the purity of the liquid 36 in the container 37 can be maintained at a sufficiently high level, thus eliminating the risk of contamination. Furthermore, the necessity of changing the liquid 36 during the surface treatment process can be eliminated, and therefore the working efficiency and the manufacturing yield can be improved. The water purifying apparatus 46 may be any of the known means for purifying water, such as devices including active carbon, ion exchange resin or any of a variety of filters or their combination. If the liquid 36 is not pure water, e.g. organics, the pure-water reproducing apparatus 46 is formed into a filtering or other devices adaptable to the type of the liquid used.

Figure 10:
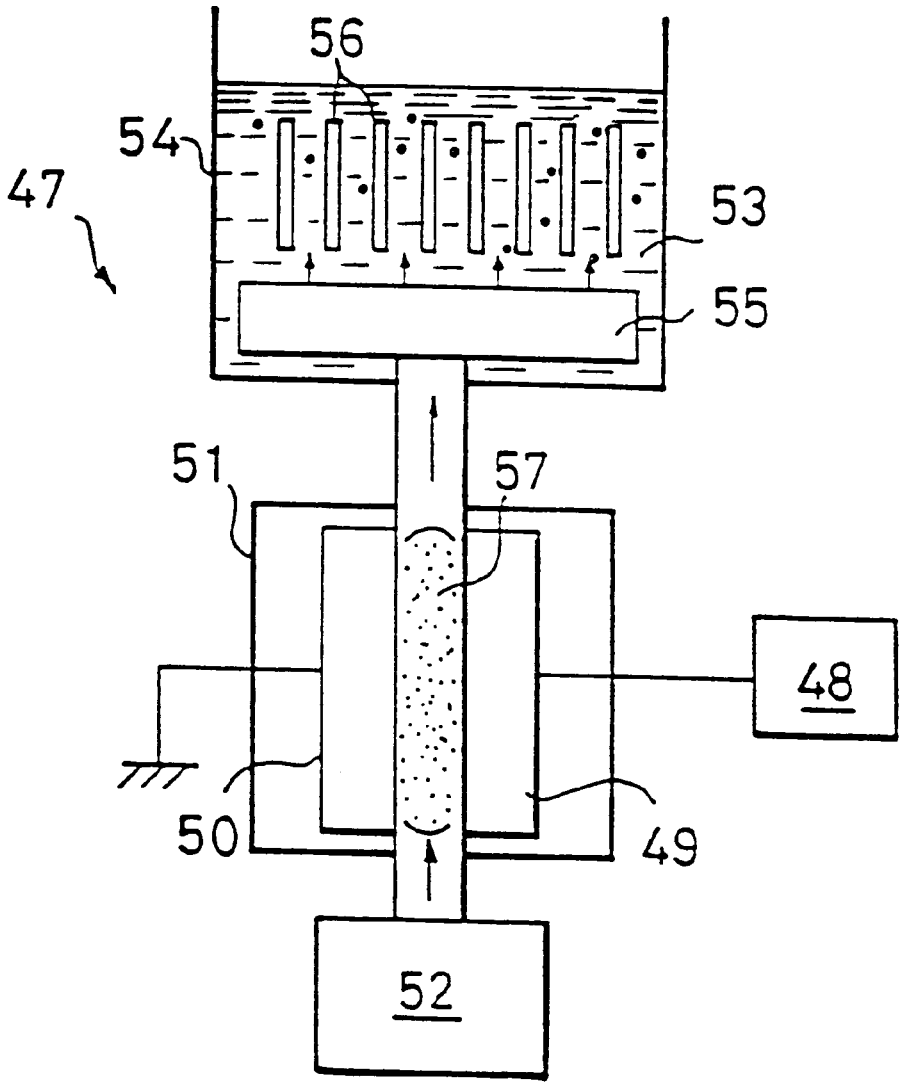
FIG. 10 is a block diagram showing a surface treatment apparatus for use in an embodiment different from that shown in FIG. 7.

FIG. 10 shows another embodiment of the surface treatment apparatus for performing surface treatment in a liquid. A surface treatment apparatus 47 according to this embodiment includes an electrode 49 connected to a power source 48 and a grounded electrode 50 corresponding to and opposite the electrode 49, the two electrodes 49 and 50 being disposed in a casing 51 and facing each other at a predetermined distance. The casing 51 has an end connected to a gas supply apparatus 52 for supplying the discharging gas, and another end connected to a nozzle 55 disposed in the bottom portion of a container 54 for accommodating a liquid 53, the nozzle 55 typically being a porous plate. A work 56 to be processed, which is, for example, a substrate, is immersed in the liquid 53 in the container 54 and is disposed above the nozzle 55. As shown, a multiplicity of works 56 to be processed may be vertically and in parallel disposed in the liquid 53 to correspond to the size of the container 54.

The gas supply apparatus 52 supplies the discharging gas into the casing 51 to replace the ambient atmosphere with the discharging gas for the space between the two electrodes 49 and 50. When voltage is applied from the power source 48 to the electrode 49, gas discharge takes place in the space between the two electrodes 49 and 50. Activated gas containing active species of the discharging gas produced in a discharge region 57 are, in the form of a reactive gas flow, supplied to the nozzle 55 at the other end of the casing 51 because the discharging gas is continuously supplied from the gas supply apparatus 52 so as to be jetted out through the nozzle 55 and into the liquid 53 in the form of bubbles. By disposing the nozzle 55 in the bottom portion of the container 54, the bubbles of the reactive gas stir the liquid 53, thus resulting in the activated gas being further uniformly mixed with the liquid 53 and creating active species within the liquid 53. Thus, the surface treatment can be uniformly applied to the entire surface of the work 56 to be processed or uniformly applied to a multiplicity of works 56 to be processed. To improve the efficiency in dissolving the reactive gas in the liquid 53, it is preferable that the diameter of each aperture of the porous plate forming the nozzle 55 be reduced.

As a result, the works 56 to be processed can be treated with a variety of surface treatments, such as oxidizing, etching and cleaning depending on the type of the discharging gas and the liquid 53, as in to the embodiments shown in FIGS. 8 and 9. Furthermore, these embodiments may have the arrangement that the container 54 and the discharge portion for producing the gas activators are separately disposed apart from each other, and they are connected to each other through an appropriate conduit so that a multiplicity of works can be applied with the surface treatment in a single container 57 or in multiple containers, by branching the conduit (not shown). Alternatively, works having various shapes, dimensions and sizes can be treated with the surface treatment by adjusting the size of the container and the quantity of the discharging gas to be supplied.

Figure 11:
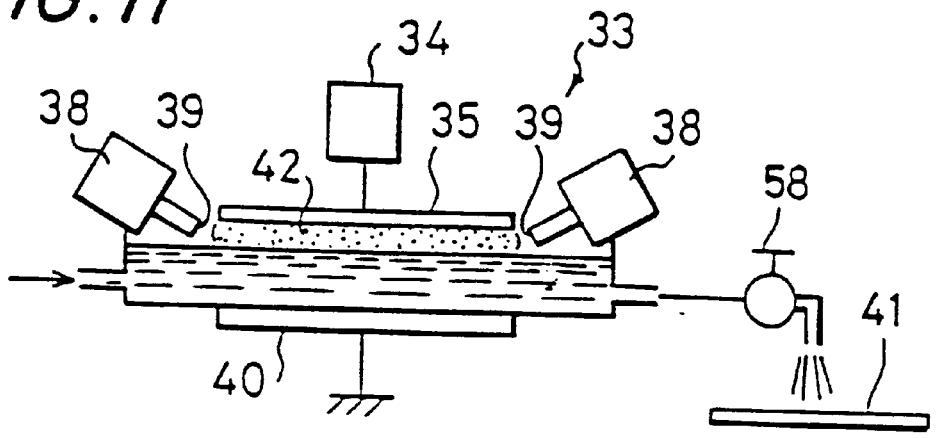
FIG. 11 is a block diagram showing a modification of the embodiment shown in FIG. 8.
Figure 12:
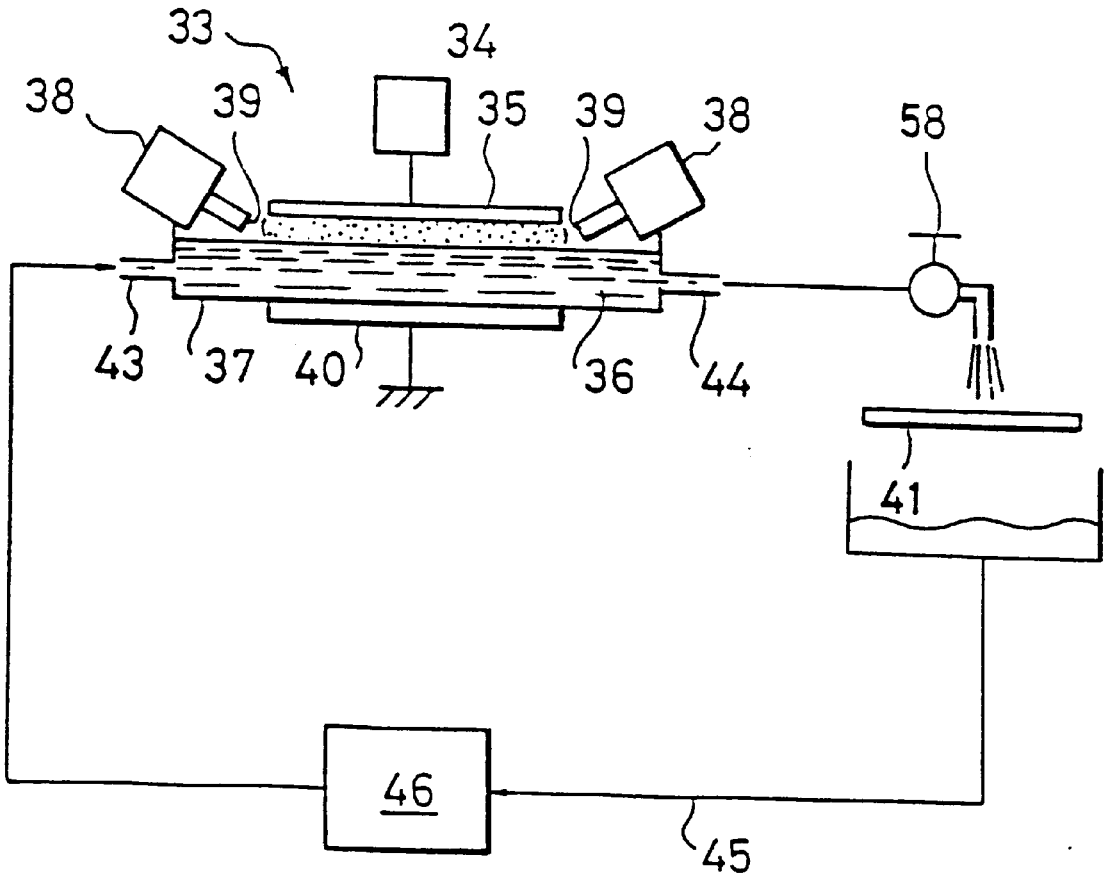
FIG. 12 is a block diagram showing a modification of the embodiment shown in FIG. 9.

FIGS. 11 and 12 show modifications of the embodiments shown in FIGS. 8 and 9. In these modifications, a work 41 to be processed is placed outside a container 37. Similarly to the embodiments shown in FIGS. 8 and 9, gas discharge is caused to take place between an electrode 35 and the surface of a liquid 36 contained in container 37, which generates activated gas including active species of the discharging gas supplied from the gas supply apparatus 38. The liquid 36, with which the activated gas has been mixed, is applied to the surface of the work 41 to be processed and the flow rate of the liquid 36 is controlled by a plug 58. According to the present invention, as in the other embodiment, by selecting the appropriate combination of the type of the liquid 36 and the discharging gas the work 41 may be treated with a variety of surface treatments, such as oxidizing, etching and ashing.

In addition, in the embodiment shown in FIG. 12, the liquid 36 is circulated to the container 37 after being subjected to a purifying process in the water purifying apparatus 46. Furthermore, the liquid 36, with which the active species of the activated gas has been mixed, is supplied from the container 37 to the work 41 to be processed and the flow rate is controlled by a plug 58. According to the foregoing modifications, the work 41 to be processed can be continuously treated with different surface treatments. For example, pure water may be continuously supplied or circulated to the container 37 to treat the surface of the work 41 to be processed in one way, and then, for example, where more than one desired surface treatment is desired, the plug 58 is closed, stopping the circulation. Then the type of the discharging gas to be supplied from the gas supply apparatus 38 is changed to change the characteristic of the liquid 36 and form a different surface treatment liquid; and the plug 58 is again opened, so that the different surface treatment may be applied to the work 41.

According to the modifications shown in FIGS. 11 and 12, the work 41 to be processed is disposed outside the container 37 in which the liquid 36 is contained. Gas discharge is caused to take place between the electrode 35 and the surface of the liquid 36, and the liquid containing activated gas is applied to a work 41. Therefore, the necessity of changing the container 37 to be adaptable to the size, dimensions and the shape of the work 41 to be processed can be eliminated. Thus, the overall size of the apparatus can be reduced and the apparatus may be conveniently situated. Furthermore, the processing performance of the apparatus can easily be controlled to be adaptable to the quantity of the works to be processed. Since the single wafer process or batch process can be selected as desired. Thus the manufacturing cost can be further reduced.

Figure 13:
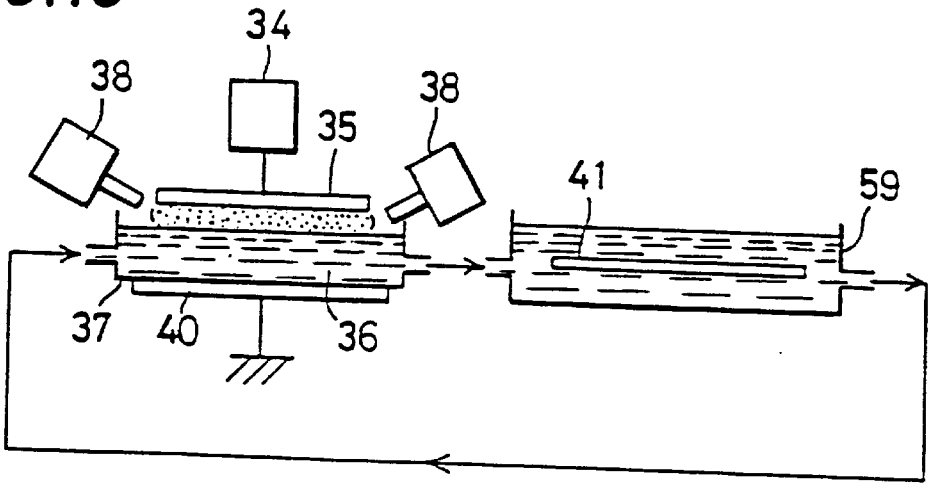
FIG. 13 is a block diagram showing another embodiment of the surface treatment method according to the present invention.

FIG. 13 shows another embodiment of the surface treatment method according to the present invention. In this embodiment, a relatively large work 41 to be processed, such as a glass for a liquid crystal panel or a wafer substrate, is placed in a cleaning chamber 59 so as to be subjected to a cleaning process using pure water continuously supplied into the cleaning chamber 59. Used pure water discharged from the cleaning chamber 59 is circulated to the container 37. Pure water used in the cleaning process contains organic substances and the like removed from the work 41 to be processed. The organic substances and the like float on the liquid surface in the container 37. The electrode 35 is connected to the power source 34 similarly to the embodiments shown in FIGS. 11 and 12 is disposed above the container 37 with a slight gap from the liquid surface level. Furthermore, the grounded electrode 40 is disposed in the bottom portion of the container 37.

Gas discharge is caused to take place while supplying the discharging gas from the gas supply apparatus 38 to the space between the electrode 35 and the liquid 36 surface. By using activated gas produced by the gas discharge, the surface of the liquid 36 is processed. By using compressed gas, mixed gas of oxygen and helium or nitrogen as the discharging gas, the organic substances floating on the liquid level in the container 37 are removed by ashing. The liquid 36 is thus cleaned of the organic substances and the like, and pure water may again be supplied to the cleaning chamber 59 so as to again be used to clean the work 41 to be processed.

As described above, according to the present invention, the work 41 to be processed is cleaned with circulating pure water in a position where the work 41 to be processed may be secured regardless of the size, shape and dimensions of the work 41 to be processed so that the work 41 to be processed is continuously cleaned. Therefore, coping with the recent trend of enlarging the size of glass substrates for liquid crystal panels and wafers can easily be accomplished. Furthermore, in this embodiment, either a single wafer or a batch can be surface treated. According to the present invention, in a case where a process such as cleaning, is performed by using a liquid other than pure water, ashing process of the material on the surface of the liquid such as organic material or the like from the work 41 enables its purity to be restored. Thus, the liquid can be circulated and used again.

Figure 14:
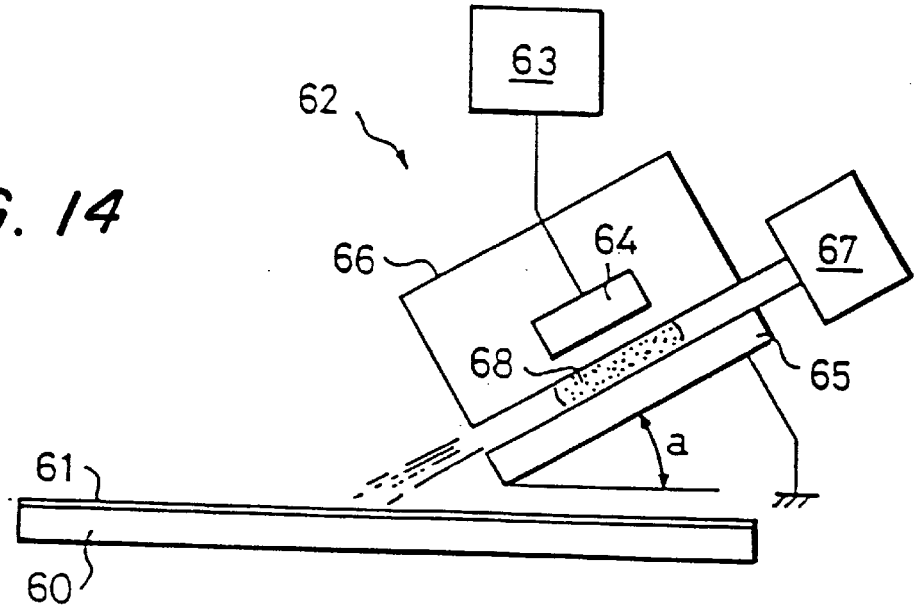
FIG. 14 is block diagram showing a method of forming an oriented film of a liquid crystal panel by using the surface treatment method according to the present invention.

FIG. 14 shows a method of forming an oriented film on a liquid crystal display apparatus to which the surface treatment method according to the present invention may be applied. A synthetic resin coating film 61 made of organic polymer resin or the like is applied to the upper surface of a confront substrate 60 of a liquid crystal panel having a device made of TFT, MIM (Metal Insulator Metal) or ITO, an electrode pattern or a color filter formed thereon. An orientation processing apparatus 62 employing the surface treatment method according to the present invention by means of plasma generated at or about atmospheric pressure is disposed above the substrate 60. The orientation processing apparatus 62 comprises a powered electrode 64 connected to a power source 63, and a grounded electrode 65 opposite and corresponding to the powered electrode 63. The powered electrode 64 connected to the power source is preferably completely coated with a glass or ceramic insulator 66. The electrode 64 coated with the insulator 66 and the electrode 65 are disposed opposite and apart from each other at a predetermined distance and face each other. Furthermore, the electrodes 64 and 65 are inclined to make a certain angle shown as a from the surface of the substrate 60 and the synthetic resin coating film 61. The angle may be any angle in the range from 0° to 90°. A space defined between the two electrodes 64 and 65 is joined to gas supply apparatus 67 for supplying the discharging gas.

When voltage is applied from the power source 63 to the electrode 64 while supplying the discharging gas from the gas supply apparatus 67 to the space between the two electrodes 64 and 65, gas discharge takes place at or about atmospheric pressure. The gas discharge may be any of glow discharge, corona discharge, arc discharge or the like so long as activated gas can be produced from the discharging gas. Since the electrode 64 is preferably covered with the insulator 66, discharge between the two electrodes 64 and 65 can be made uniform. Alternatively, in this embodiment, the grounded electrode 65 may be coated with the insulator in place of coating the electrode 64 adjacent to the power source 63. The two electrodes 64 and 65 may also both be coated with the insulator.

Active species in the activated gas created from discharging gas produced in a discharge region 68 due to the gas discharge are, by the discharging gas continuously supplied from the gas supply apparatus 67, formed into a reactive gas flow which may be sprayed from the orientation processing apparatus 62 to the surface of the synthetic resin coating film 61 at an angle a. As a result, the surface of the synthetic resin coating film 61 is oriented to the right when viewed in FIG. 14. By moving the substrate 60 back and forth and right and left with respect to the orientation processing apparatus 62, the entire surface of the synthetic resin coating film 61 can be oriented uniformly.

FIG. 15 shows an embodiment of a line-type orientation processing apparatus according to the present invention. The orientation processing apparatus 69 comprises a gas supply apparatus 67, a discharge generating portion 70 having a power source electrode and a grounded electrode similarly to the embodiment shown in FIG. 14, and a jetting-out nozzle 71. The jetting-out nozzle 71 is preferably made of insulating material, such as glass or ceramic. The jetting-out nozzle 71 has a straight-shape jetting-out port 72 having a small width, as, for example, an air knife. The jetting-out nozzle 71 is disposed adjacent to the surface of the substrate 60 having the synthetic resin coating film 61 formed thereon in such a manner that the jetting-out port 72 makes a certain angle a (0°<a<90°) from the surface of the substrate 60.

Figure 15A:
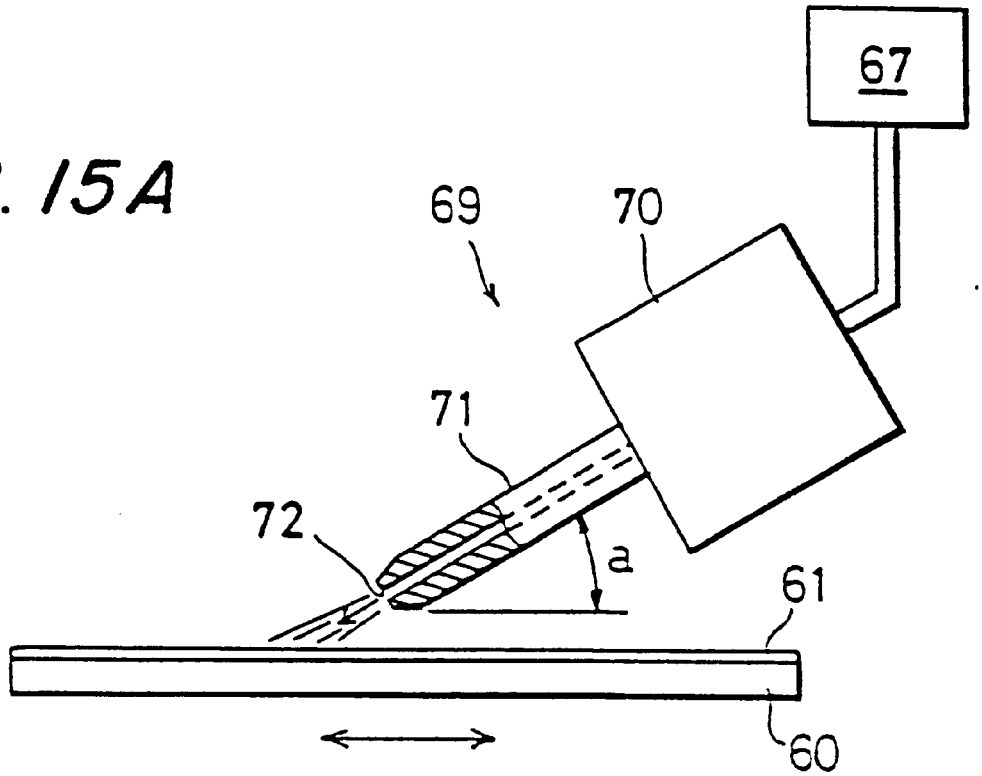
FIG. 15(A) is a side view schematically showing an embodiment of a line-type orientation processing apparatus.
Figure 15B:
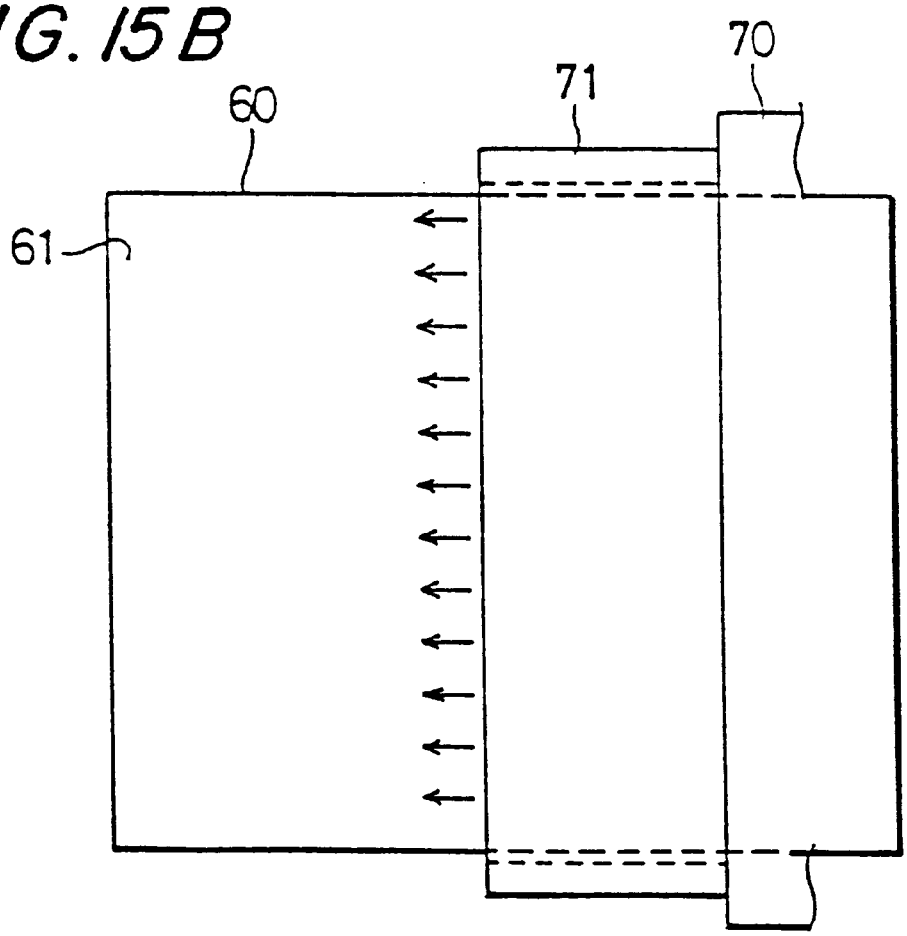
FIG. 15(B) is a top view of the apparatus shown in FIG. 15(A)

When a predetermined discharging gas is supplied from the gas supply apparatus 67 to the discharge generating portion 70 and voltage is supplied to the power source electrode, gas discharge takes place in the discharging gas at or about atmospheric pressure. Active species of the discharging gas produced in the discharge generating portion 70 due to the gas discharge are formed into a reactive gas flow because the discharging gas is continuously supplied from the gas supply apparatus 67. Thus, the reactive gas flow is jetted out through the jetting-out port 72 of the jetting-out nozzle 71 to the surface of the synthetic resin coating film 61 of the substrate 60 from a diagonally upper position to cover the overall width of the synthetic resin coating film 61, as shown in FIGS. 15(A) and 15(B) in such a manner that the angle a is made relative to the surface of the synthetic resin coating film 61.

As a result, the synthetic resin coating film 61 is oriented similarly to the embodiment shown in FIG. 14. It is preferable that the reactive gas flow be jetted out at a pressure of, for example, about 7 kg/cm$^2$ because the orientation can be attained more efficiently and quickly in proportion to the pressure. By moving the substrate 60 to the right and left with respect to the orientation processing apparatus 69, the entire surface of the synthetic resin coating film 61 can easily be processed. Furthermore, the discharge generating portion 70 and the jetting-out nozzle 71 can be connected to each other by an appropriate conduit, such as a flexible tube for conveniently manipulating the jetting out nozzle.

The discharging gas is preferably gas containing at least oxygen, such as compressed air, mixed gas of nitrogen and oxygen or mixed gas of oxygen and helium. In this case, the gas discharge causes active species, such as ozone and oxygen radicals, to be produced in the activated gas. In a case where the discharging gas is compressed air or the mixed gas of nitrogen and oxygen, high potential is applied between the two electrodes of the discharge generating portion 70 in order to create discharge. The discharge is typically corona discharge in this case. In a case where the discharging gas is mixed gas of helium and oxygen, a high-frequency power source of, for example, 13.56 MHz, may be used to generate glow discharge.

Figure 16:
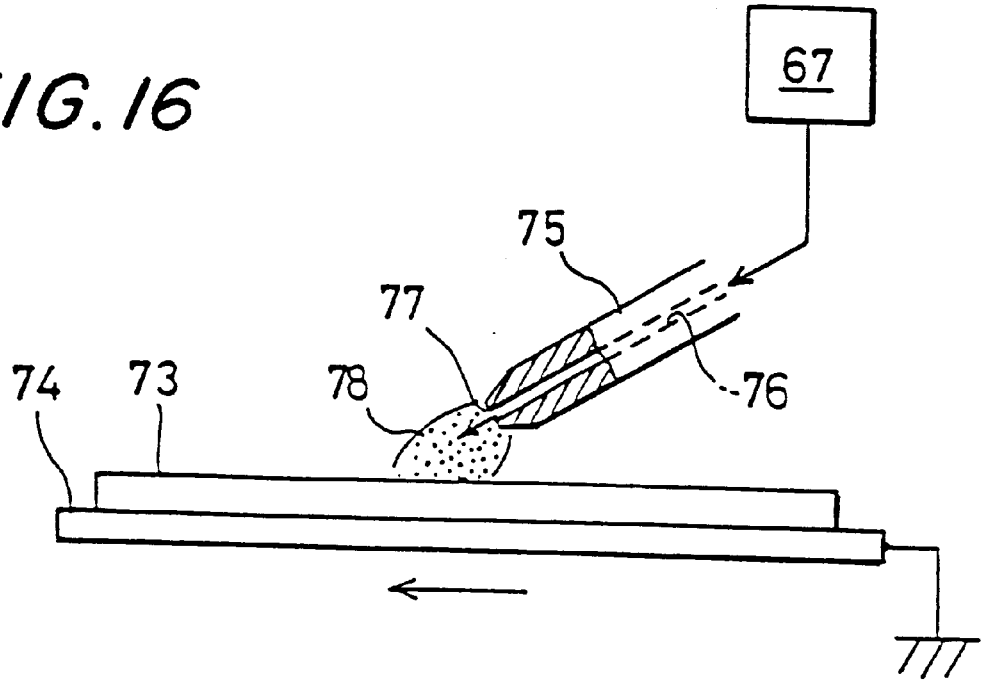
FIG. 16 is a block diagram showing an embodiment of the orientation processing apparatus different from that shown in FIG. 15.

FIG. 16 shows another embodiment of the method of forming an oriented film for a liquid crystal panel according to the present invention. In this embodiment, a substrate 73 to be subjected to the orientation process is placed on a grounded metal plate 74. Furthermore, a powered metal electrode 75 is disposed just above the substrate 73 on the metal plate 74. The powered electrode 75 is shaped into an air knife structure similar to the jetting-out nozzle 71 of the embodiment shown in FIG. 15 such that it comprises a passage 76 connected to the gas supply apparatus 67 and an elongated-slit-shaped jetting-out port 77.

The electrode 75 is, as shown in FIG. 16, positioned relative to the substrate 73 in such a manner that the discharging gas is jetted out to the surface of the substrate 73 through the jetting-out port 77 at an angle relative to the substrate. A predetermined discharging gas is supplied from the gas supply apparatus 67 into the passage 76. Simultaneously, high-frequency voltage is applied to the powered electrode 75 from the power source while jetting out the discharging gas to the surface of the substrate 73 through the jetting-out port 77. The metal plate 74 acts as a grounded electrode opposing to the electrode 75 so that discharge takes place between the leading end of the electrode 75 and the substrate 73. In a discharge region 78, active species of the discharging gas are produced in the activated gas so as to be sprayed to the surface of the substrate 73 by the discharging gas continuously jetted out through the jetting-out port 77. As a result, the surface of the substrate can be oriented as desired.

In a case where the synthetic resin coating film has been previously formed on the surface of the substrate 73 similarly to the embodiments shown in FIGS. 14 and 15, mixed gas of helium and oxygen is used. In this case, the activated gas contains active species such as ozone and oxygen radicals which are produced as in the foregoing embodiments. Thus, the synthetic resin coating film is oriented by the surface treatment of the invention similar to ashing.

According to the present invention, the orientation process can be performed in a non-contact manner as described above. Therefore, a risk of the surface of the synthetic resin coating film being damaged and separated can be minimized. Furthermore, uniform orientation can be obtained. The angle of the oriented film is controlled mainly by adjusting the angle at which the reactive gas is sprayed relative to the work, and partially by adjusting the voltage to be applied to the electrode and the type of the discharging gas. Therefore, the specific angle of the resulting oriented film can be controlled relatively easily.

In an alterative embodiment, the discharging gas contains an appropriate organic substance. Therefore, an oriented film can be formed directly on the surface of the substrate in a single surface treatment and surface orientation process. If, for example, decane ($C_{10}H_{22}$) is added to helium for example, or if silicon is added to helium, the resin film that is deposited is polymerized in the desired direction of orientation so as to be formed on the surface of the substrate 73 in a particular orientation directly. If oxygen and silicon are added to helium, a silicon oxide ($SiO_2$) film is formed in a particular orientation.

Figure 17:
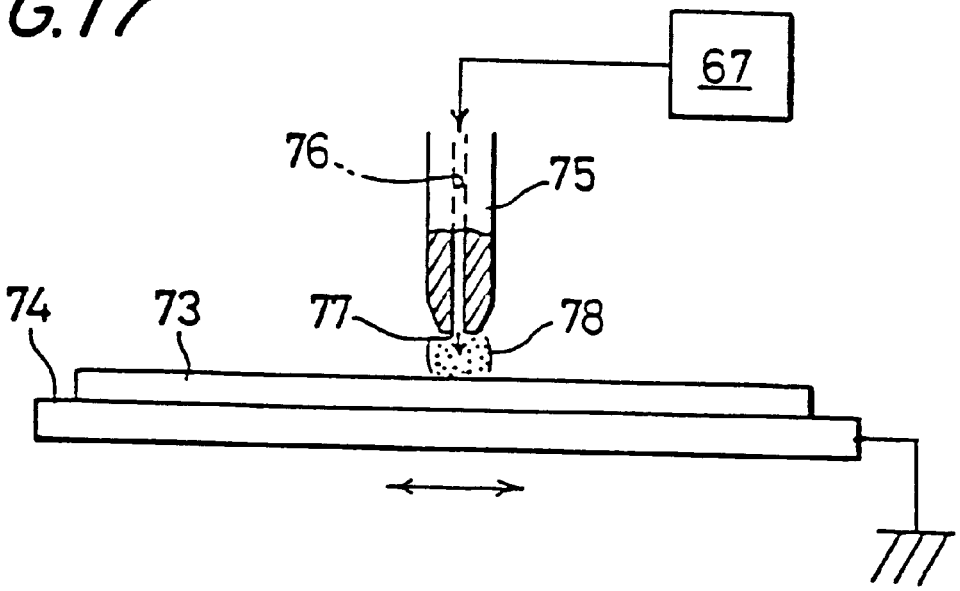
FIG. 17 is a block diagram showing a modification of the embodiment shown in FIG. 16.

FIG. 17 shows a modification of the embodiment shown in FIG. 16, with which an oriented film is formed directly on the substrate. In this modification, the electrode 75 is disposed vertically rather than at an angle to cause the discharging gas to be sprayed substantially perpendicularly to the substrate 73 through the jetting-out port 77. The substrate 73 is moved orthogonally with respect to the electrode 75 to the right or left, or back or forth simultaneously with the discharge. Thus, appropriate setting of the substrate moving speed to correspond to the film forming speed will enable the resin film to be oriented in a direction dependent on the direction of movement. As a result, a desired oriented film can be formed.

Examples of the method of forming the oriented film for a liquid crystal panel according to the present invention will now be specifically described.

EXAMPLE 1

Figure 18:
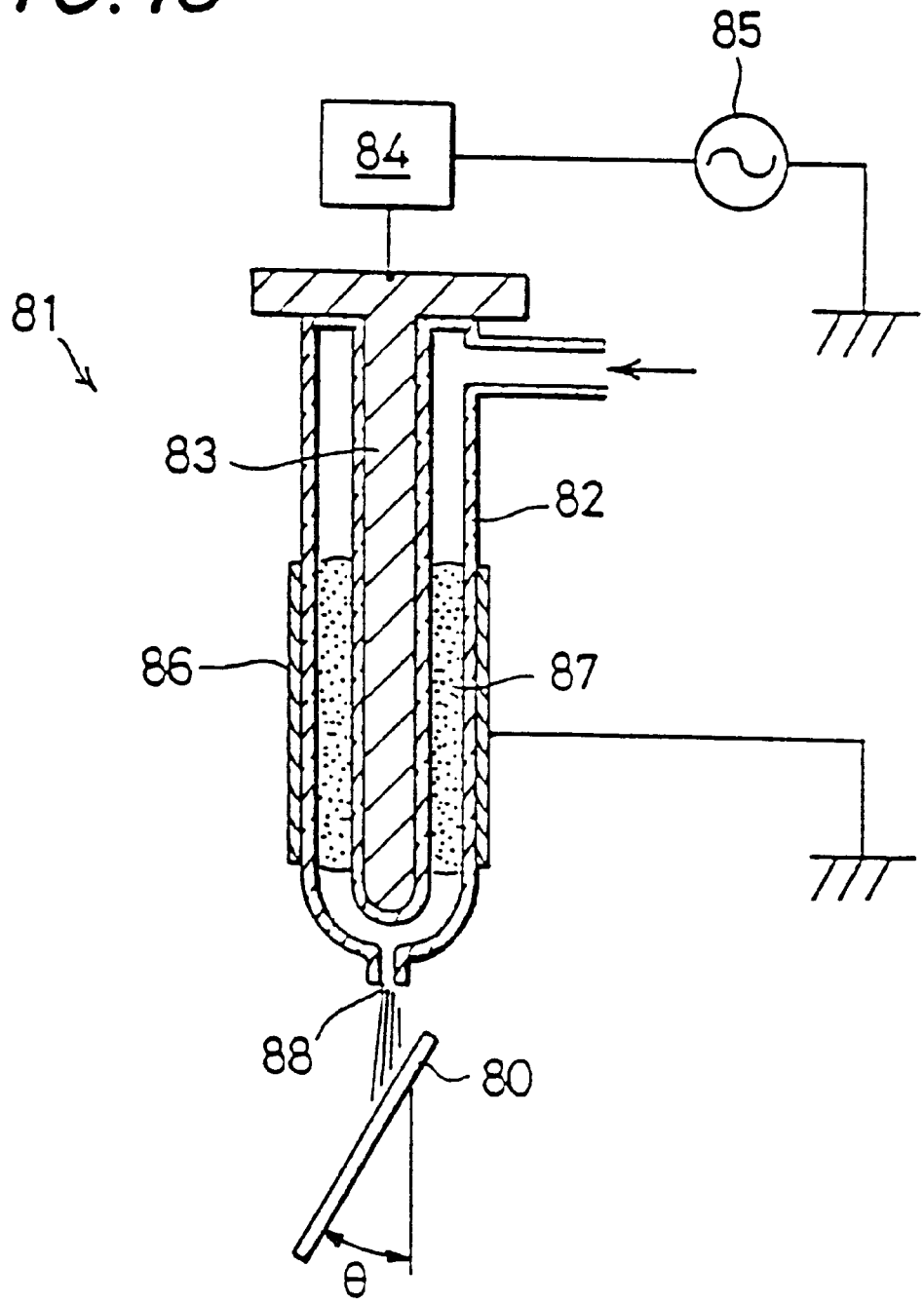
FIG. 18 is a sectional view showing an apparatus for orienting a liquid crystal panel by using a spot-type surface treatment apparatus.

As shown in FIG. 18, a polyimide coating film on the surface of an MIM substrate 80 having a circuit pattern formed thereon was subjected to an orientation process by using a surface treatment apparatus 81 of a spot type. The orientation conditions was as follows: the surface treatment apparatus 81 comprised an electrode 83 disposed at the center of a quartz pipe 82 having a double-wall structure, the electrode 83 being connected to a power source 85 through a control circuit 84. Discharge was caused to take place between the electrode 83 and a grounded electrode 86 disposed outside the quartz pipe 82. The discharging gas was continuously supplied from outside to the inside of the quartz pipe 82 so that a gas flow containing active species of the discharging gas produced in a discharge region 87 was jetted out through a gas jetting-out port 88 to the surface of the substrate 80. The substrate 80 was placed relative to the gas jet to make an angle a=10° to 30° from the gas flow. The other conditions were:

Gas: Compressed air

Gas Pressure: 3 to 7 kg/cm$^2$

Electric Power Supplied: 100 to 200 W

Time Period: 20 minutes

Liquid crystal was disposed between the substrate 80 subjected to the orientation process and a substrate having an oriented film formed by a conventional rubbing process. Polarizing plates were disposed on both two sides. The liquid crystal was irradiated with light so that the state of orientation could be observed. As a result, a portion of the polyimide coating film on the liquid crystal which was exposed to the gas flow was confirmed to be oriented in the direction of the gas flow.

EXAMPLE 2

Figure 19A:
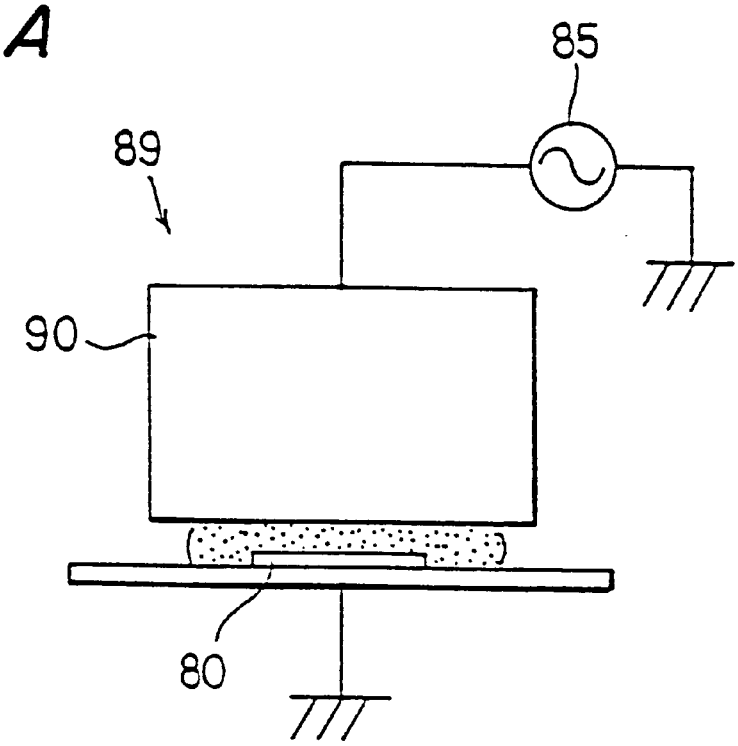
FIG. 19(A) is a side view showing a line-type surface treatment apparatus for use in the method of orienting a liquid crystal panel.
Figure 19B:
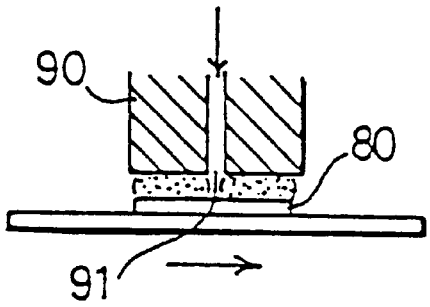
FIG. 19(B) is a partial cross sectional view showing the apparatus shown in FIG. 19(A)

A polyamide coating film on the surface of an MIM substrate 80 having a circuit pattern similarly to Example 1 was subjected to an orientation process by using a surface treatment apparatus 89 of a line type shown in FIGS. 19(A) and 19(B), the orientation conditions being as follows: the surface treatment apparatus 89 comprised an elongated gas jetting-out port 91 formed in the bottom surface of the powered electrode 90 connected to a power source 85, the jetting-out port 91 being formed in the lengthwise direction of the surface of the bottom of the powered electrode 90. While jetting out discharging gas to the surface of the substrate 80 which was moved horizontally just below the gas jetting-out port 91, the polyamide coating film was directly exposed to the activated gas generated by the discharge. The other conditions were:

| | |
|---|---|
| Gas | Mixed gas of Helium and Oxygen |
| Flow Rate of Gas | Helium 20 liters/minute<br>Oxygen 100 ccm |

-continued

| | |
|---|---|
| Electric Power Supplied | 100 V, 13.56 MHz |
| Time Period | One Minute |

Similarly to Example 1, the state of orientation on the polyamide coating film was observed, resulting in excellent orientation being confirmed over the entire surface of the substrate.

EXAMPLE 3

Figure 20A:
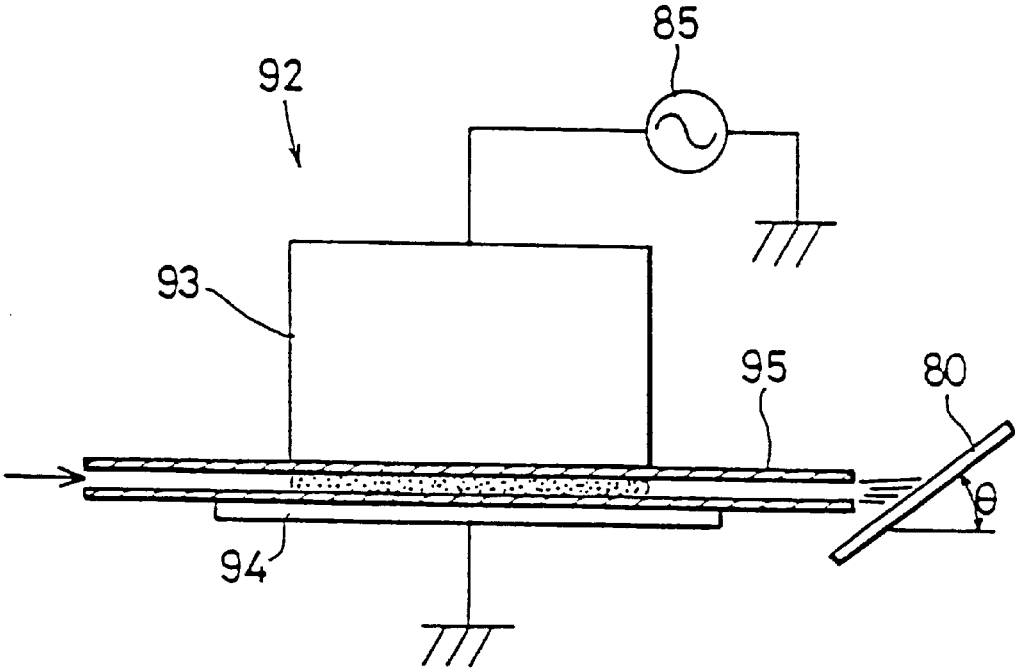
FIG. 20(A) is a side view showing a spot-type surface treatment apparatus for use in the method of orienting a liquid crystal panel.
Figure 20B:
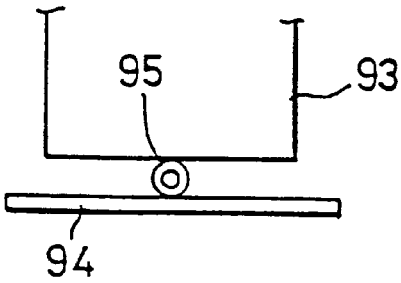
FIG. 20(B) is an end view of the surface treatment apparatus shown in FIG. 20(A)

Similarly to Examples 1 and 2, a polyamide coating film on the surface of an MIM substrate 80 having a circuit pattern was subjected to an orientation process by using a surface treatment apparatus 92 of a spot type shown in FIGS. 20(A) and 20(B), the orientation conditions being as follows: the surface treatment apparatus 92 comprised an elongated glass pipe 95 disposed between a power source electrode 93 and a grounded electrode 94. While sending the discharging gas from an end of the glass pipe 95 to another end of the same, discharge was caused to take place between the two electrodes 93 and 94. The substrate 80 was placed adjacent to the other end of the glass pipe 95 to make an angle of a=10° to 30° relative to the substrate from a gas flow jetted out through an opening formed at the other end of the glass pipe 95. The other conditions were:

| | |
|---|---|
| Gas | Mixed gas of Helium and Oxygen |
| Flow Rate of Gas | Helium 20 liters/minute<br>Oxygen 100 ccm |
| Electric Power Supplied | 100 V, 13.56 MHz |
| Time Period | One to Three Minutes |

Similarly to Example 1, the orientation on the polyamide coating film was observed. As a result, orientation being established in processing periods from one minute to three minutes was confirmed. In this example, since the substrate 80 was not directly exposed to the discharge, the risk of charging up can be eliminated. Since the processing speed was relatively low, the orientation process can be controlled relatively easily.

In any one of Examples 1 to 3, it can be considered from the types of the discharging gas used that surface treatment similar to ashing may also be applied to the polyamide coating film of the substrate 80 so that a cleaning of the film, as well as the orientation was performed.

EXAMPLE 4

Figure 21:
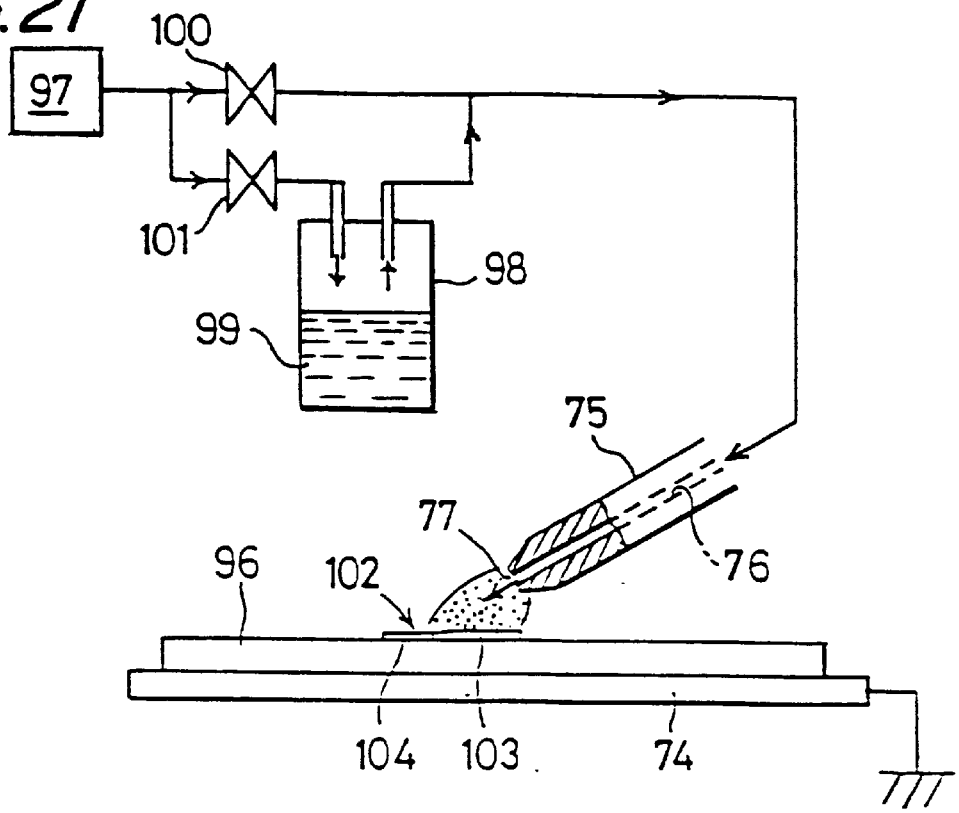
FIG. 21 is a block diagram schematically showing the method of forming an oriented film of a liquid crystal panel according to the present invention.

An oriented film was directly formed on the surface of a Pyrex glass substrate 96 having no circuit pattern formed thereon by using a surface treatment apparatus shown in FIG. 21. The surface treatment apparatus had a structure similar to that of Example shown in FIG. 16 so that discharge was caused to directly take place between the power source electrode 75 and a glass substrate 96 on the grounded electrode 74. The discharging gas was supplied such that organic substances 99, which were liquid at room temperature, in a container 98 were appropriately supplied and adjusted by control valves 100 and 101 so as to be mixed with gas supplied from a gas supply apparatus 97. The activated gas thus formed was jetted to the surface of the substrate 96 through the gas jetting-out port 77 by way of the passage 76 in the electrode 75. As a result, a polymerized film 102 of the organic substances 99 was formed on the surface of the glass substrate 96. The gap from the electrode 75 to the surface of the substrate 96 was 1 mm, and the angle of inclination of the electrode 75 made from the substrate 96 was a=60°. The other conditions were:

| | |
|---|---|
| Gas | Helium |
| Flow Rate of Gas | 20 liters/minute |
| Liq. Organic Substance | OH-Denatured Silicone,<br>Silicone Oil, n-Decane |
| Electric Power Supplied | 150 W |

The state of orientation was then observed as in the prior examples. A portion 103 of the polymer film 102 adjacent to the gas jetting-out port 77 was not oriented, however a portion 102 apart from the gas jetting-out port 77 was oriented.

EXAMPLE 5

Figure 22:
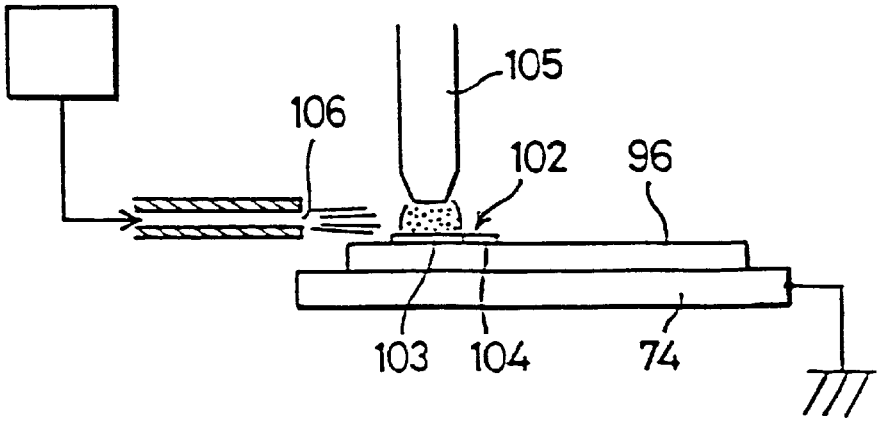
FIG. 22 is a block diagram showing a modification of the embodiment shown in FIG. 21.

An oriented film was directly formed on the surface of a glass substrate 96 of the same type as that used in Example 4 was formed under the following conditions: as shown in FIG. 22, discharge was caused to directly take place between the glass substrate 96 disposed on the grounded electrode 74 and a power source electrode 105. Simultaneously, the discharging gas was jetted out from a side position to the discharge region through a gas jetting-out port 106. The discharging gas of the same type used in Example 4 was used so that a polymer film 102 was formed on the surface of the substrate. The other conditions were:

| | |
|---|---|
| Gas | Helium |
| Flow Rate of Gas | 20 liters/minute |
| Liq. Organic Substance | OH-Denatured Silicone,<br>Silicon Oil, n-Decane |
| Electric Power Supplied | 150 W |

The polymer film 102 was not oriented in its portion 103 adjacent to the gas jetting-out port 106, but it was oriented in a portion 104 apart from the jetting-out port 106, similarly to Example 4.

EXAMPLE 6

Figure 23:
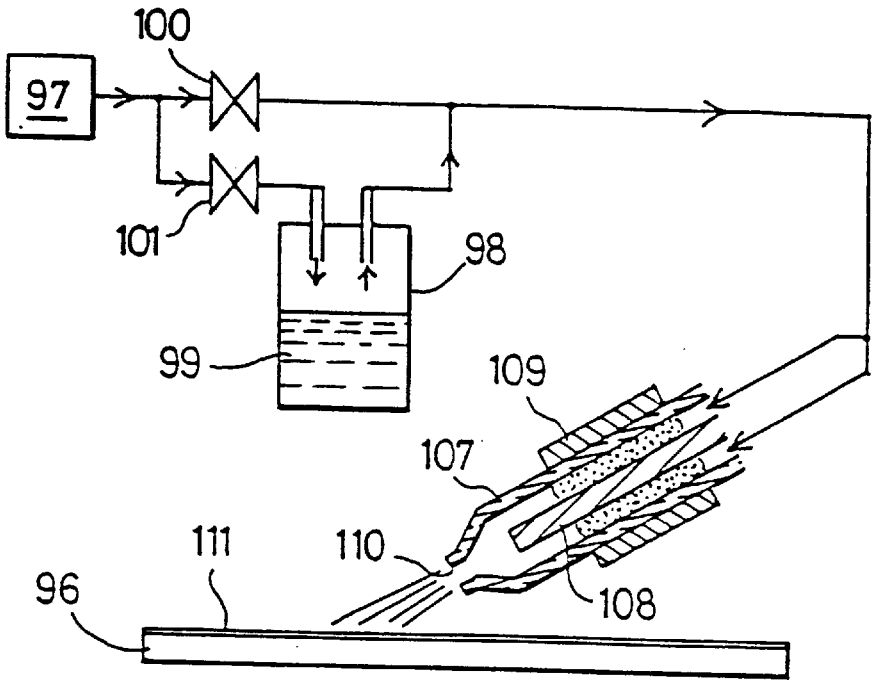
FIG. 23 is a block diagram showing a partial sectional view of another embodiment of an apparatus for forming an oriented film of a liquid crystal panel according to the present invention.

An oriented film was formed directly on the surface of the glass substrate 96 similar to that according to Example 4 by using a surface treatment apparatus shown in FIG. 23 under the following conditions: the discharging gas, with which organic substances 99 which were liquid at room temperature similarly to Example 4 were mixed, was supplied into a dielectric member 107. Thus, discharge was caused to take place between a powered electrode 108 in the dielectric member 107 and an outside grounded electrode 109. A gas flow containing active species of the gas produced from the discharge was jetted out through a gas jetting-out port 110 to the surface of the glass substrate 96 at a diagonal angle of a=60° relative to the surface of the glass substrate 96. Thus, a polymer film 111 was formed on the entire surface of the glass substrate 96. The polymer film was not oriented. The other conditions were:

Gas: Helium

Flow Rate of Gas: 20 liters/minute

Liq. Organic Substance: OH-Denatured Silicone

Electric Power Supplied: 150 W

Figure 24:
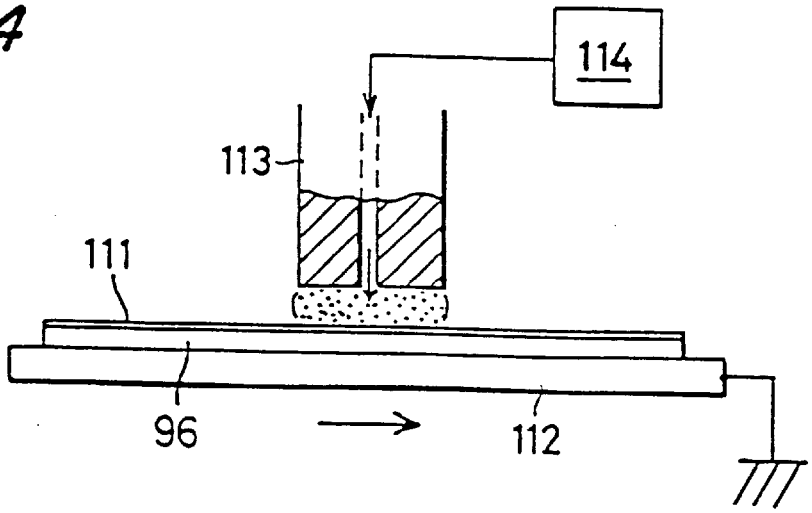
FIG. 24 is a diagram showing a different orientation of the embodiment shown in FIG. 23.

Then, as shown in FIG. 24, discharge was caused to take place directly between a power source electrode 113 and the grounded electrode 112 while moving horizontally the glass substrate 96 placed on the grounded electrode 112. As the discharging gas, helium, nitrogen, compressed air or the like, typically used to perform surface treatment for improving wettability, was supplied from a gas supply apparatus 114. As a result, a polymer film 111 became oriented satisfactorily on the entire surface of the substrate 96.

EXAMPLE 7

An MIM substrate having a circuit pattern was used to perform an experiment similarly to Example 6. As a result, a polymer film oriented satisfactorily was formed on the surface of the substrate after the second surface treatment, similarly to Example 6.

Although the invention has been described in its preferred forms with a certain degree of particularity, it is understood that the present disclosure of the preferred forms can be changed in the details of construction and the combination and arrangement of parts may be changed too without departing from the spirit and the scope of the invention. For example, each of the surface treatment apparatuses may preferably have either or both electrodes coated with an insulator or a dielectric material similarly to the example shown in FIG. 14, in order to cause discharge to take place uniformly and promote glow, rather than arc or corona discharge. Furthermore, damage and wear of the electrode due to the discharge, and contamination of the work to be processed with substances generated due to the wear can be prevented by the insulator or dielectric coat.

By forming the electrode of the surface treatment apparatus into a flat shape and by disposing the same vertically, a surface treatment apparatus of a so-called line type can be constituted in which discharge is caused to take place linearly in the lengthwise direction of the electrode. The gas discharger of the surface treatment apparatus may also have any of the following structures: a structure as disclosed by the applicants of the present invention in Japanese Patent Application No. 5-11320 may be employed, in which the discharging gas is introduced into a gas passage formed by dielectric material, and high-frequency voltage is applied to an electrode disposed outside the gas passage to cause gas discharge to take place in the gas passage at or about atmospheric pressure so as to form active species of the activated gas produced due to the gas discharge, which is then used to perform the surface treatment; or any of the gas discharger embodiments described in U.S. patent application Ser. No. 08/372,755, of which the entire specification is hereby incorporated by reference.

The present invention as described above, can achieve the following effects.

According to the surface treatment method for a substrate disclosed above, a metal layer on the surface of the substrate can be oxidized at high speed, without damage of other portions of the substrate, for example, electrode elements, by e.g. masking such other portions, so that a metal oxide film is formed on the surface. Therefore, corrosion of circuit and electrodes formed on the substrate can efficiently be prevented so that the reliability of the electronic circuit is improved and the lifetime is lengthened.

According to the method of forming a multi-layer circuit substrate disclosed above, the surface treatment method is used so that the surface of a first metal circuit is covered with a metal oxide to have corrosion resistance. Thereafter, when the second metal circuit is etched, the risk of undesirable etching for the first metal circuit formed below the second metal circuit can be minimized. Thus, the necessity of excessively thickening the interlayer insulating film formed between the two metal layers can be eliminated, that is, the interlayer insulating film can be maintained thinned. Therefore, the time required to form the film can be shortened, and the cost can be reduced so that the manufacturing yield is improved. Furthermore, a desirable thin substrate can be produced.

According to the surface treatment method for a substrate disclosed above, the metal oxide layer on the surface of the substrate can easily and quickly be reduced and metallized without damage to other portions of the substrate, for example, the electronic elements and the like. If the metal oxide layer is a transparent electrode made of ITO or the like, the thickness of the electrode can be thin and yet a reduced resistance maintained while maintaining the transparency. Therefore, desired electrical performance can be realized.

According to the surface treatment method disclosed above, an appropriate selection of the liquid and discharging gas will enable the liquid to have, at a low cost, surface treatment performance, such as oxidizing, etching, cleaning or the like equivalent to that of peroxide and ammonia peroxide. The liquid used in the surface treatment, such as cleaning, can easily be purified so as to be used again to reduce the cost. Therefore, the cost can be reduced, and handling can be performed relatively easily and safely. Thus, the working efficiency can be improved significantly. In particular, the discharge of gas forming activated gas may be performed separate from the liquid and jetted to the liquid surface remotely and the surface treatment of a work to be processed using the liquid may also be performed at a separate location so that the surface treatment is performed regardless of the dimensions, shape and the position of the work to be processed. Thus, desired single wafer process or a batch process can be selected, and the work to be processed can be continuously subjected to different surface treatments. Therefore, the size of the surface treatment apparatus can be reduced, and the processing performance can be improved. The surface treatment method can be realized with a low cost and a relatively simple structure.

According to the surface treatment method disclosed above, the portion in which the gas discharge is caused to take place and the portion in which the work to be processed is subjected to the surface treatment are separately provided, the two portions are connected to each other so as to supply the gas containing active gas species to the liquid, and the liquid is used to treat the surface of the work to be processed. Therefore, the surface treatment can be performed and is adaptable to the specific processing conditions, for example, the object of the process, the shape and dimensions of the work to be processed, the number of the works to be processed simultaneously, the type of the gas for use in the gas discharge and the environment in which the gas discharge is caused to take place. Furthermore, the single wafer process or the batch process can be selected to meet the object and the purposes required. Since the processing operation, such as handling of the discharging gas, can be performed relatively easily and safely, the manufacturing yield can be improved. The foregoing surface treatment method can be realized with a relatively simple structure and a low cost.

According to the method of forming an oriented film of a liquid crystal disclosed above, the gas flow containing gas activators is jetted at an angle relative to the surface of a substrate. Therefore, the a synthetic resin coating film on the surface of the substrate can be oriented in a non-contact manner. According to the method disclosed above, the oriented film can be formed directly on the surface of the substrate. Therefore, the risk of damage and peeling of the oriented film can be eliminated as has been experienced with conventional technology. Therefore, the yield can be improved. Since the processing time can be shortened and the single wafer process can be performed, the manufacturing yield can be improved significantly, and the cost can be reduced.

Furthermore, the surface treatment method and apparatus according to the present invention do not require a reduced pressure or vacuum environment. Therefore, the overall structure of the apparatus can be simplified and the size of the same can be reduced. Since the gas discharge is caused to take place at or about atmospheric pressure, the quantity of electrons and ions is very small with respect to the active species. Therefore, damage of the work to be processed as by electrical damage can be minimized satisfactorily. Since the surface treatment can be performed quickly, the cost can be further reduced.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all generic and specific features of the invention herein described, and all statements of the scope of the invention which, as a matter of language, might be said to fall therebetween.

What is claimed is:

1. A method of surface treatment of a substrate comprising the steps of:

converting a gas capable of discharge to a plasma state exhibiting gas discharge at or about atmospheric pressure, thereby creating active species;

exposing a liquid to said active species produced by said discharge, thereby creating activated liquid; and exposing a substrate to the activated liquid by immersing the substrate in the activated liquid so that said substrate is surface treated.

2. A method of surface treatment of a substrate according to claim 1, wherein:

the liquid is contained in a bath where it is exposed to the active species produced by the discharge;

the activated liquid is circulated from said bath and through a purifier; and purified liquid is returned to said bath.

3. A method of surface treatment of a substrate comprising the steps of:

converting a gas capable of discharge to a plasma state exhibiting gas discharge at or about atmospheric pressure, thereby creating active species;

exposing a liquid to said active species produced by said discharge thereby creating activated liquid; and exposing a substrate to said activated liquid by spraying the substrate with the activated liquid so that said substrate is surface treated;

wherein the liquid is contained in bath where it is exposed to the active species produced by the discharge;

the activated liquid is collected after spraying the substrate;

the activated liquid is circulated from where it is collected and through a purifier; and purified liquid is returned to said bath.

4. A method of surface treatment of a substrate comprising the steps of:

converting a gas capable of discharge to a plasma state exhibiting gas discharge at or about atmospheric pressure, thereby creating active species;

exposing a liquid to said active species produced by said discharge, thereby creating activated liquid; and exposing a substrate to said activated liquid so that said substrate is surface treated, wherein the step of exposing the liquid to the active species includes causing the active species to bubble through the liquid.

5. A method of surface treatment of a substrate according to claim 4, wherein the step of exposing a substrate to the activated liquid includes:

immersing the substrate in the activated liquid.

6. A method of surface treatment of a substrate according to claim 5, wherein:

the liquid is contained in a bath where it is exposed to the active species produced by the discharge;

the activated liquid is circulated from said bath and through a purifier; and purified liquid is returned to said bath.

7. A method of surface treatment of a substrate according to claim 4, wherein the step of exposing a substrate to the activated liquid includes:

spraying the substrate with the activated liquid.

8. A method of surface treatment of a substrate according to claim 7, wherein:

the liquid is contained in a bath where it is exposed to the active species produced by the discharge;

the activated liquid is collected after spraying the substrate;

the activated liquid is circulated from where it is collected and through a purifier; and purified liquid is returned to said bath.

* * * * *